US008011045B2

(12) United States Patent
Skripps

(10) Patent No.: US 8,011,045 B2
(45) Date of Patent: Sep. 6, 2011

(54) LOCALIZED PATIENT SUPPORT

(75) Inventor: Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 32 days.

(21) Appl. No.: 11/758,818

(22) Filed: Jun. 6, 2007

(65) Prior Publication Data

US 2007/0283496 A1 Dec. 13, 2007

Related U.S. Application Data

(60) Provisional application No. 60/812,722, filed on Jun. 12, 2006.

(51) Int. Cl.
*A47C 16/00* (2006.01)

(52) U.S. Cl. ..... 5/655.5; 5/632; 5/644; 5/654

(58) Field of Classification Search ..... 5/740, 737, 5/702, 655.9, 630, 632, 636, 644, 652, 654, 5/655.5, 653
See application file for complete search history.

(56) References Cited

U.S. PATENT DOCUMENTS

| | | | | |
|---|---|---|---|---|
| 2,688,142 | A | 9/1954 | Jensen | |
| 3,308,491 | A * | 3/1967 | Spence | 5/676 |
| 3,605,145 | A | 9/1971 | Graebe | |
| 3,656,190 | A | 4/1972 | Regan et al. | |
| 3,694,831 | A | 10/1972 | Treace | |
| 3,919,730 | A | 11/1975 | Regan | |
| 4,054,960 | A | 10/1977 | Pettit et al. | |
| 4,472,847 | A | 9/1984 | Gammons et al. | |
| 4,504,050 | A | 3/1985 | Osborne | |
| 4,706,313 | A | 11/1987 | Murphy | |
| 4,710,991 | A | 12/1987 | Wilmore et al. | |
| 4,723,329 | A | 2/1988 | Vaccaro | |
| 4,752,064 | A | 6/1988 | Voss | |
| 4,757,983 | A | 7/1988 | Ray et al. | |
| 4,788,730 | A | 12/1988 | Bexton | |
| 4,918,774 | A | 4/1990 | Popitz | |
| 4,944,059 | A | 7/1990 | Wall | |
| 4,944,060 | A | 7/1990 | Peery et al. | |
| 4,955,096 | A | 9/1990 | Gilroy et al. | |
| 5,044,026 | A | 9/1991 | Matthews | |
| 5,052,068 | A | 10/1991 | Graebe | |
| 5,081,728 | A | 1/1992 | Skinner | |
| 5,220,699 | A | 6/1993 | Farris | |
| 5,259,079 | A * | 11/1993 | Visser et al. | 5/685 |
| 5,269,035 | A | 12/1993 | Hartunian | |
| 5,287,576 | A | 2/1994 | Fraser | |
| 5,513,402 | A * | 5/1996 | Schwartz | 5/691 |
| 5,520,623 | A | 5/1996 | Williams | |
| 5,613,501 | A | 3/1997 | Michelson | |
| 5,638,565 | A | 6/1997 | Pekar | |
| 5,708,999 | A | 1/1998 | Priolo et al. | |
| 5,771,514 | A | 6/1998 | Wilhoit | |

(Continued)

*Primary Examiner* — Michael Trettel
*Assistant Examiner* — William Kelleher
(74) *Attorney, Agent, or Firm* — Barnes & Thornburg LLP

(57) ABSTRACT

A localized patient support comprises a base, an annular ring supported above the base and defining a cavity, and a gel pad having a plurality of sections located in the cavity. In some embodiment, the localized patient support includes an insert received in the cavity and located between the base and the gel pad. At least some of the sections of the gel pad located in the cavity are vertically movable substantially independently of adjacent sections of the gel pad. In some embodiments, the base, the annular ring, and the insert comprise foam elements. In other embodiments, the base and the annular ring comprise foam elements and the insert comprises individually inflatable and deflatable air bladders.

27 Claims, 30 Drawing Sheets

U.S. PATENT DOCUMENTS

| | | | | |
|---|---|---|---|---|
| 5,960,494 | A | 10/1999 | Gilliland et al. | |
| 6,115,861 | A | 9/2000 | Reeder et al. | |
| 6,151,735 | A | 11/2000 | Koby et al. | |
| 6,154,903 | A | 12/2000 | Wai-Chung | |
| 6,154,907 | A | 12/2000 | Cinquin | |
| 6,212,720 | B1 * | 4/2001 | Antinori et al. | 5/727 |
| 6,241,711 | B1 | 6/2001 | Weissberg et al. | |
| D456,516 | S | 4/2002 | Chesnaek et al. | |
| 6,367,106 | B1 | 4/2002 | Gronsman | |
| 6,427,272 | B1 | 8/2002 | Yacoub | |
| RE38,135 | E | 6/2003 | Stolpmann et al. | |
| 6,598,251 | B2 * | 7/2003 | Habboub et al. | 5/654 |
| 6,701,556 | B2 * | 3/2004 | Romano et al. | 5/653 |
| 7,059,001 | B2 * | 6/2006 | Woolfson | 5/740 |
| 7,146,664 | B1 | 12/2006 | Grosvenor | |
| 2003/0205920 | A1 * | 11/2003 | Sprouse et al. | 297/219.1 |
| 2004/0123391 | A1 * | 7/2004 | Call | 5/630 |
| 2005/0151410 | A1 * | 7/2005 | Sprouse | 297/452.41 |
| 2005/0166330 | A1 * | 8/2005 | Williams | 5/740 |
| 2007/0113352 | A1 * | 5/2007 | Poulos | 5/727 |

* cited by examiner

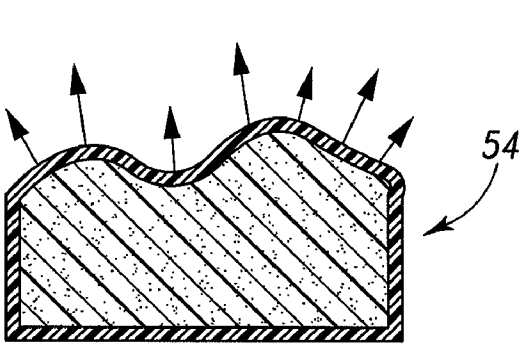
Fig. 8
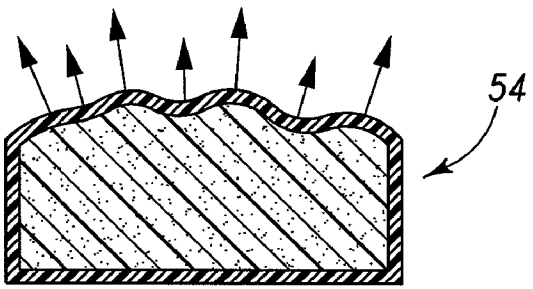
Fig. 9
Fig. 10
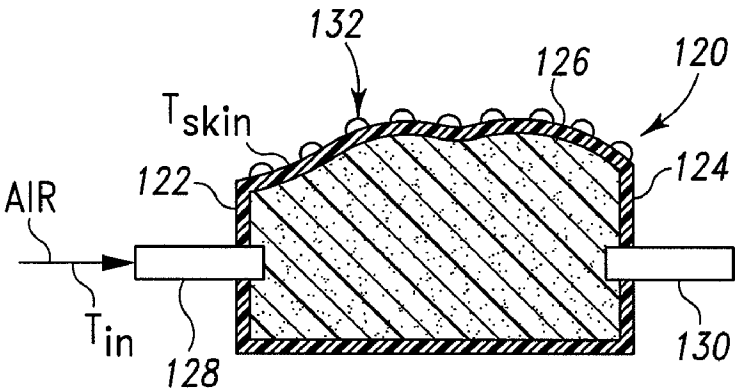
Fig. 11
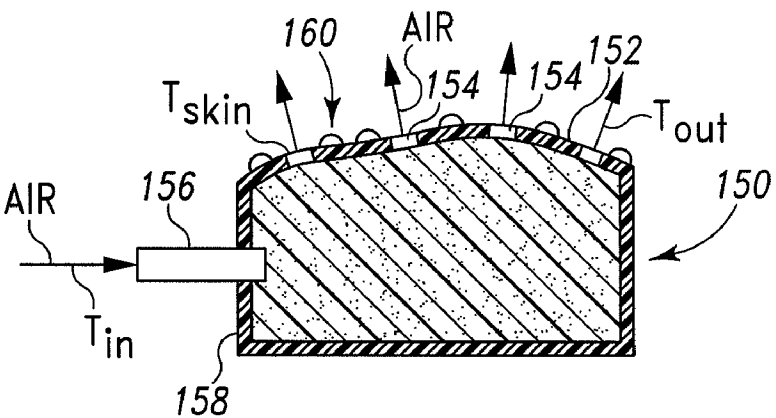
Fig. 12

LOCALIZED PATIENT SUPPORT

CROSS REFERENCE TO RELATED APPLICATION

This application claims the benefit of U.S. Provisional Patent Application, Ser. No. 60/812,722, filed on Jun. 12, 2006, and entitled "INTRA-OPERATIVE SKIN CARE CONTROLLED PATIENT SUPPORT," which is hereby incorporated by reference herein.

BACKGROUND OF THE INVENTION

The present disclosure relates to localized patient supports that attach to surgical tables or surgical accessory frames and that are configured to support a patient during surgery, such as, for example, spinal surgery. More particularly, the present disclosure relates to controlling the variables that affect the integrity of the skin of a patient supported on localized patient supports over extended periods during relatively long surgeries.

The variables that affect the integrity of a patient's skin are of concern in hospitals and health care facilities around the world. Some examples of such variables are pressure, temperature, moisture, circulation, and skin shear. Lack of management in these areas can lead to lesions, pressure ulcers, nerve damage, and destruction of tissue. Some hospital beds may provide for management of these issues. However, many times the damage to the skin or tissue may be initiated in the operating room ("OR") where the surgeries may last more than two hours. During the long surgeries (lasting over 2 hours), such as spine, cardiovascular and hip replacement surgeries, the contact areas between the patient and the patient supports may create extreme conditions that may lead to skin breakdown and tissue damage.

Patients are typically positioned in prone, supine, or lateral positions during such surgeries. For example, during spine surgeries, patients are typically supported in prone positions over the pelvis and the chest areas while allowing the abdomen to hang free. This creates localized areas of high contact pressure on an immobile patient for a duration that is typically over 6 hours. Also, in such surgeries that extend over long periods of time, the staff may have a tendency to lean a little more heavily on the patient, which enhances the pressure concerns.

SUMMARY OF THE INVENTION

The present invention comprises an apparatus that has one or more of the features listed in the appended claims, or one or more of following features or thereof, which alone or in any combination may comprise patentable subject matter:

A patient support apparatus may include a plurality of spaced-apart localized patient supports arranged to be placed under a patient such that portions of the patient between adjacent patient supports are not supported. In some embodiments, at least one localized patient support may comprise a base, an annular ring supported above the base and defining a cavity, and a gel pad having a plurality of sections located in the cavity. In some embodiment, the localized patient support includes an insert received in the cavity and located between the base and the gel pad. At least some of the sections of the gel pad located in the cavity may be vertically movable substantially independently of adjacent sections of the gel pad.

The base may comprise at least one foam pad. The annular ring may comprise a foam ring. In some embodiments, the insert may comprise a foam insert. In other embodiments, the insert may comprise a plurality of bladders which are independently inflatable and deflatable. Each section of the gel pad received in the cavity may be positioned above at least one bladder. In some embodiments, each section of the gel pad received in the cavity is positioned above at least two bladders. The at least one patient support may further comprise at least two sensors located above each section of the gel pad received in the cavity.

The at least one patient support may further comprise a disposable cover having stretchable anti-shear portion configured to cover a top surface of the annular ring and top surfaces of the sections of the gel pad received in the cavity. The at least one patient support may further comprise a foam pad supported above the stretchable anti-shear portion of the cover. The gel pad may further comprise an annular section overlying the annular ring. The sections of the gel pad received in the cavity may have a first thickness and the annular section of the gel pad overlying the annular ring may have a second thickness smaller than the first thickness.

The sections of the gel pad received in the cavity may be sized so that top surfaces of the sections of the gel pad are substantially coplanar with a top surface of the annular ring. The sections of the gel pad received in the cavity may be sized so that peripheral walls of the adjacent sections of the gel pad are in a confronting relation to limit their lateral movement. The sections of the gel pad received in the cavity may be sized so that a top surface of the annular ring and top surfaces of the sections of the gel pad received in the cavity may define a substantially continuous surface upon which a portion of a patient rests. The gel pad may further comprise a plurality of downwardly-depending relatively thin web portions interconnecting adjacent sections of the gel pad.

In some embodiments, a localized patient support may comprise a base, an annular ring supported above the base and defining a cavity, and a single air bladder received in the cavity. In other embodiments, a localized patient support may comprise a base, an annular ring supported above the base and defining a cavity, and multiple air bladders received in the cavity.

A pressure control system may comprise a base, a plurality of vertically-adjustable air bladders extending upwardly from the base, a sectioned gel pad supported above the bladders, a plurality of pressure sensors coupled to the gel pad, a pressure regulator coupled to the bladders, and a signal processor coupled to the pressure sensors and coupled to the bladders.

In some embodiments, the at least one patient support may have an upwardly-facing patient support surface, an inlet on a first side through which air enters the at least one patient support and an outlet on a second side through which the air exits the at least one patient support. In other embodiments, the temperature and/or humidity of the air entering the patient support may be varied to keep the temperature and/or humidity near a patient's skin within a specified limit. In still other embodiments, the at least one patient support comprises a plurality of bladders. In such embodiments, the pressure in the bladders may be varied to control the pressure experienced by a patient's skin.

In some other embodiments, the at least one patient support may have an upwardly-facing low air loss patient support surface and an inlet on a first side thereof through which the air enters the patient support and exits the patient support through the low air loss patient support surface. In still other embodiments, a tube may have an opening located near the upwardly-facing surface of the at least one patient support to draw air away from a patient's skin. In yet other embodiments, the temperature and/or humidity of the air entering the patient support may be varied to keep the temperature and/or humidity near a patient's skin within a specified limit.

In other embodiments, the at least one patient support may include a base and a patient support pad to be disposed between the patient and a top surface of the base. The patient support pad may have an inlet on a first side thereof through which air enters the patient support pad and an outlet on a second side thereof through which the air exits the patient support pad. In some embodiments, the patient support pad may be hydrophilic. In yet other embodiments, the at least one patient support may include a base and a rolling sheet to be disposed between the patient and a top surface of the base. The rolling sheet may have a top surface of relatively high friction facing the patient and a bottom surface of relatively low friction facing the base.

In other embodiments, the at least one patient support may include a base, a plurality of foam blocks extending upwardly from the base, and a rolling sheet to be disposed between the patient and the top surfaces of the foam blocks. In still other embodiments, the at least one patient support may include a foam base, a plurality of vertically-stacked adjustable bladders extending upwardly from the foam base, and a cover enclosing the plurality of vertically-stacked adjustable bladders. In yet other embodiments, the at least one patient support may include a foam base and a single adjustable bladder supported above the foam base.

In other embodiments, the at least one patient support may include a base, a plurality of vertically-stacked adjustable bladders supported above the base, and a foam layer supported above the vertically-stacked adjustable bladders. In still other embodiments, the at least one patient support may include a foam base and a plurality of bladders supported above the foam base, with the bladders providing a segmented upwardly-facing patient support surface.

In other embodiments, the at least one patient support may include a foam base, a plurality of vertically-extending adjustable bladders supported above the foam base, and a cover enclosing the bladders. In still other embodiments, the at least one patient support may include a foam base having a plurality of bores and a plurality of vertically-stacked adjustable bladders located in the bores. In yet other embodiments, the at least one patient support may include a plurality of foam inserts supported above the plurality of vertically-stacked adjustable bladders.

In other embodiments, the at least one patient support may include an upwardly-facing low air loss patient support surface, an inlet through which air enters the at least one patient support, and a plurality of openings in the upwardly-facing patient support surface through which the air exits the patient support. In still other embodiments, the at least one patient support may include a plurality of vertically-extending adjustable bladders and a plurality of foam inserts located between the plurality of vertically-extending adjustable bladders.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which:

FIG. 8 is a side elevation view of a localized patient support showing a variable pressure distribution on an upwardly-facing patient support surface thereof;

FIG. 9 is a side elevation view, similar to FIG. 8, of a localized patient support showing an even pressure distribution on an upwardly-facing patient support surface thereof;

FIG. 10 is a side elevation view, similar to FIGS. 8 and 9, of a localized patient support showing a modified pressure distribution on an upwardly-facing patient support surface thereof in which the pressure is reduced at a localized area;

FIG. 11 is a side elevation view of a localized patient support showing the air entering the localized patient support through an inlet on a first side thereof and exiting the localized patient support through an outlet on a second side thereof;

FIG. 12 is a side elevation view of a localized patient support showing the air entering the localized patient support through an inlet on a first side thereof and exiting the localized patient support through an upwardly-facing low air loss patient support surface thereof;

DETAILED DESCRIPTION OF THE DRAWINGS

Figure 1:
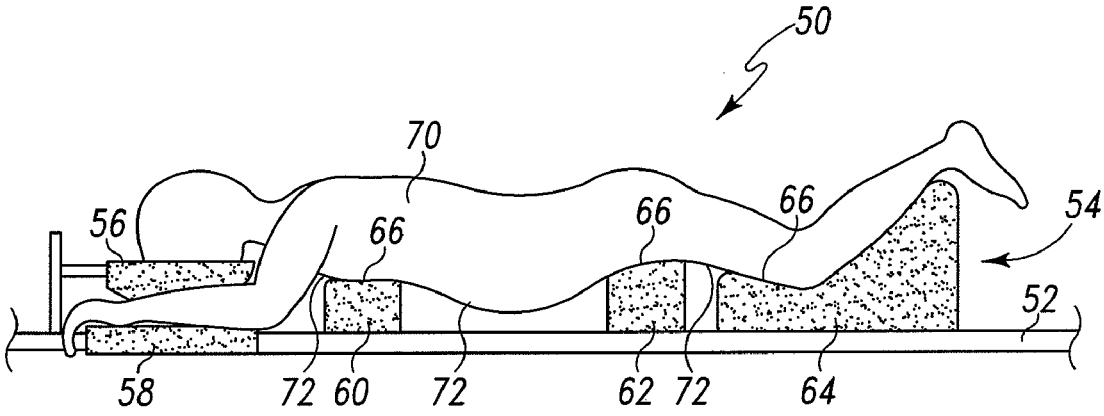
FIG. 1 is a side elevation view of a portion of a patient support apparatus showing the patient support apparatus including a patient support frame, a plurality of localized patient supports, such as a head support, arm supports, chest supports, hip supports and leg supports, attached to the patient support frame, and a patient supported on the patient supports in a prone position.

Referring to FIG. 1, the present disclosure relates to a patient support apparatus 50 that attaches to a surgical table and that is configured to support patients during surgery, such as, for example, spinal surgery. The patient support apparatus 50 includes a longitudinal patient support frame 52 and a plurality of spaced-apart localized patient supports 54, such as a head support 56, arm supports 58, chest supports 60, hip supports 62 and leg supports 64, attached to the patient support frame 52. As shown in FIG. 1, a patient 70 is supported on the patient supports 54 in a prone position such that portions 72 of the patient 70 between adjacent patient supports 54 are not supported. Each patient support 54 has an upwardly-facing patient support surface 66 which is contoured to match the contour of the associated body portion of the patient 70, such as, for example, the chest area, the pelvis area, the leg area, and the like. Typically, the entire upwardly-facing surface 66 of a patient support 54 contacts a portion of a patient's anatomy, such as a portion of a patient's chest. Also, as shown in FIGS. 1-4, the contoured top surfaces 66 of the spaced-apart patient supports 54 are located at several levels depending on the type of surgery. In the illustrated embodiments, the patient support frame 52 and the patient supports 54 are made from radiolucent materials to allow imaging of patients supported thereon during spinal surgery.

U.S. patent application Ser. No. 11/402,330, entitled "Accessory Frame for Spinal Surgery," discloses an illustrative accessory frame (i.e., the patient support apparatus) suitable for spinal surgeries. U.S. patent application Ser. No. 11/402,332, entitled "Head Support Apparatus for spinal Surgery," discloses a head support. U.S. patent application Ser. No. 11/402,327, entitled "Body Support Apparatus for Spinal Surgery," discloses illustrative chest and hip supports. The U.S. patent application Ser. Nos. 11/402,330, 11/402,332, and 11/402,327, all filed on Apr. 11, 2006, are hereby incorporated by reference herein.

Figure 2:
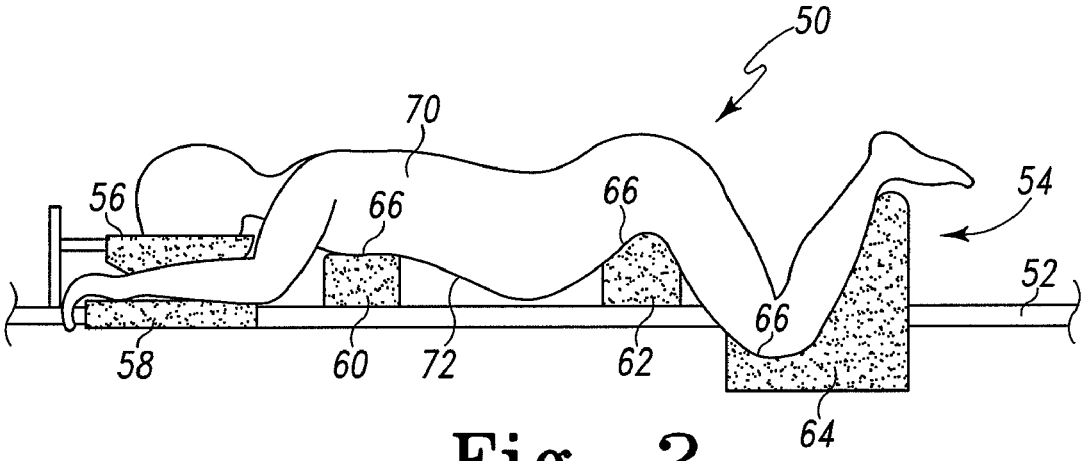
FIG. 2 is a side elevation view, similar to FIG. 1, showing a patient supported in a prone position with an acute angle at the hip.
Figure 3:
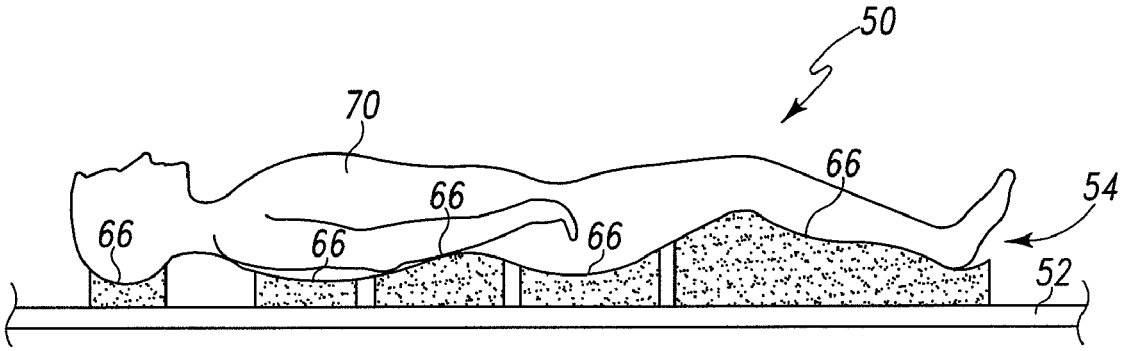
FIG. 3 is a side elevation view, similar to FIGS. 1 and 2, showing a patient supported in a supine position.
Figure 4:
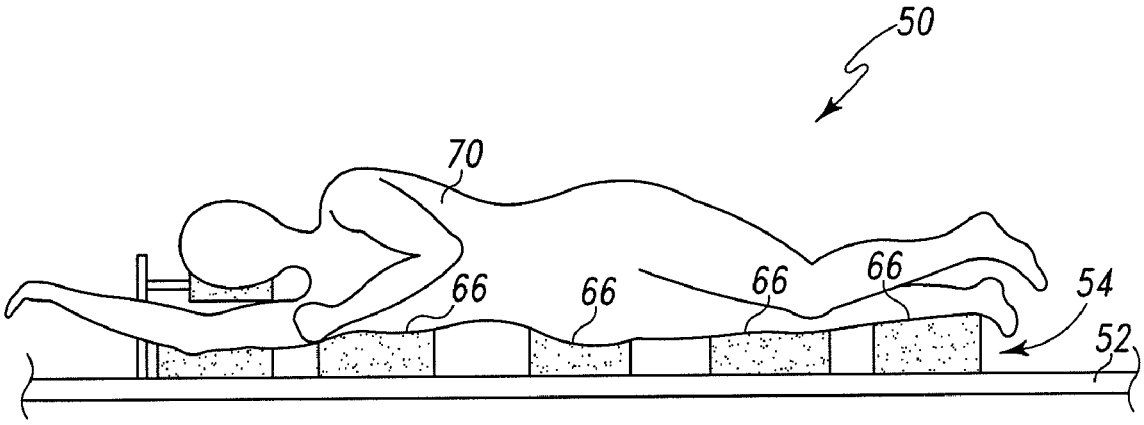
FIG. 4 is a side elevation view, similar to FIGS. 1-3, showing a patient supported in a lateral position.

FIG. 2 shows a patient 70 supported in a prone position with an acute angle at the hip, for example, for a prone spine surgery. FIG. 3 shows a patient 70 supported in a supine position, for example, for an interior spine surgery or a cardiovascular surgery or a hip surgery. FIG. 4 shows a patient 70 supported in a lateral position, for example, for a lateral spine surgery or a hip surgery. The number, geometry and the size of patient supports 54 vary depending upon the type of surgery. For example, the chest and hip supports 60, 62 in FIG. 2 may in some embodiments have vertical dimensions that are greater than the corresponding vertical dimensions of the chest and hip supports 60, 62 in FIG. 1. Also, the hip supports 62 in FIG. 2 have more curved upwardly-facing patient support surfaces 66 than the upwardly-facing patient support surfaces 66 of the hip supports 62 in FIG. 1. In addition, the leg supports 64 in FIG. 2 are more curved and located at a lower level than the leg supports 64 in FIG. 1 so that a patient can be supported with an acute angle at the hip.

Figure 5:
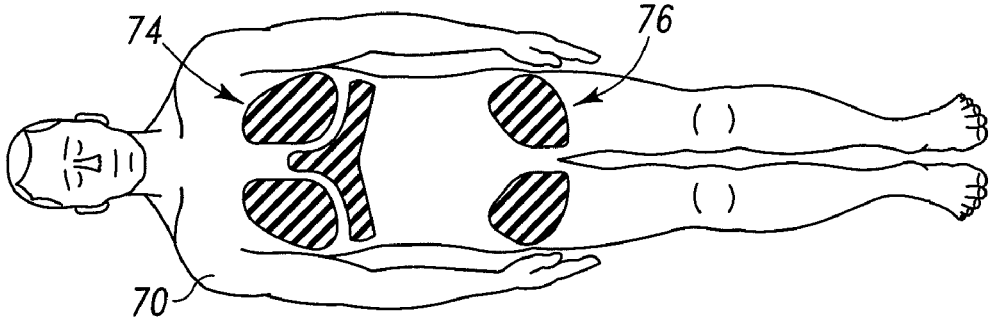
FIG. 5 is a front view showing portions of a patient's body prone to pressure ulcers for a patient supported in a prone position during long surgeries.
Figure 6:
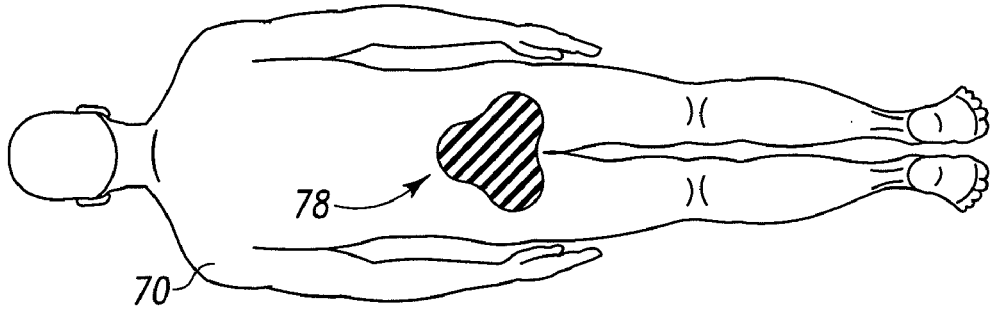
FIG. 6 is a back view showing portions of a patient's body prone to pressure ulcers for a patient supported in a supine position during long surgeries.

This disclosure addresses some of the variables that affect the integrity of a patient's skin during long surgeries (lasting more than two hours). Some examples of the variables that affect the integrity of a patient's skin during long surgeries include the pressure exerted by the patient supports 54 on a patient's skin, the temperature of the patient supports 54 adjacent a patient's skin, the moisture or relative humidity at or near a patient's skin, the skin shear, the air circulation, and the like. It is well known that portions of a patient's body subjected to relatively high pressures over extended periods of time can lead to pressure ulcers. For example, FIG. 5 shows portions of a patient's body prone to pressure ulcers in the chest and pelvis regions 74, 76 of a patient supported in a prone position during long surgeries. FIG. 6 shows portions of a patient's body prone to pressure ulcers in the sacral region 78 of a patient supported in a supine position during long surgeries.

Figure 7:
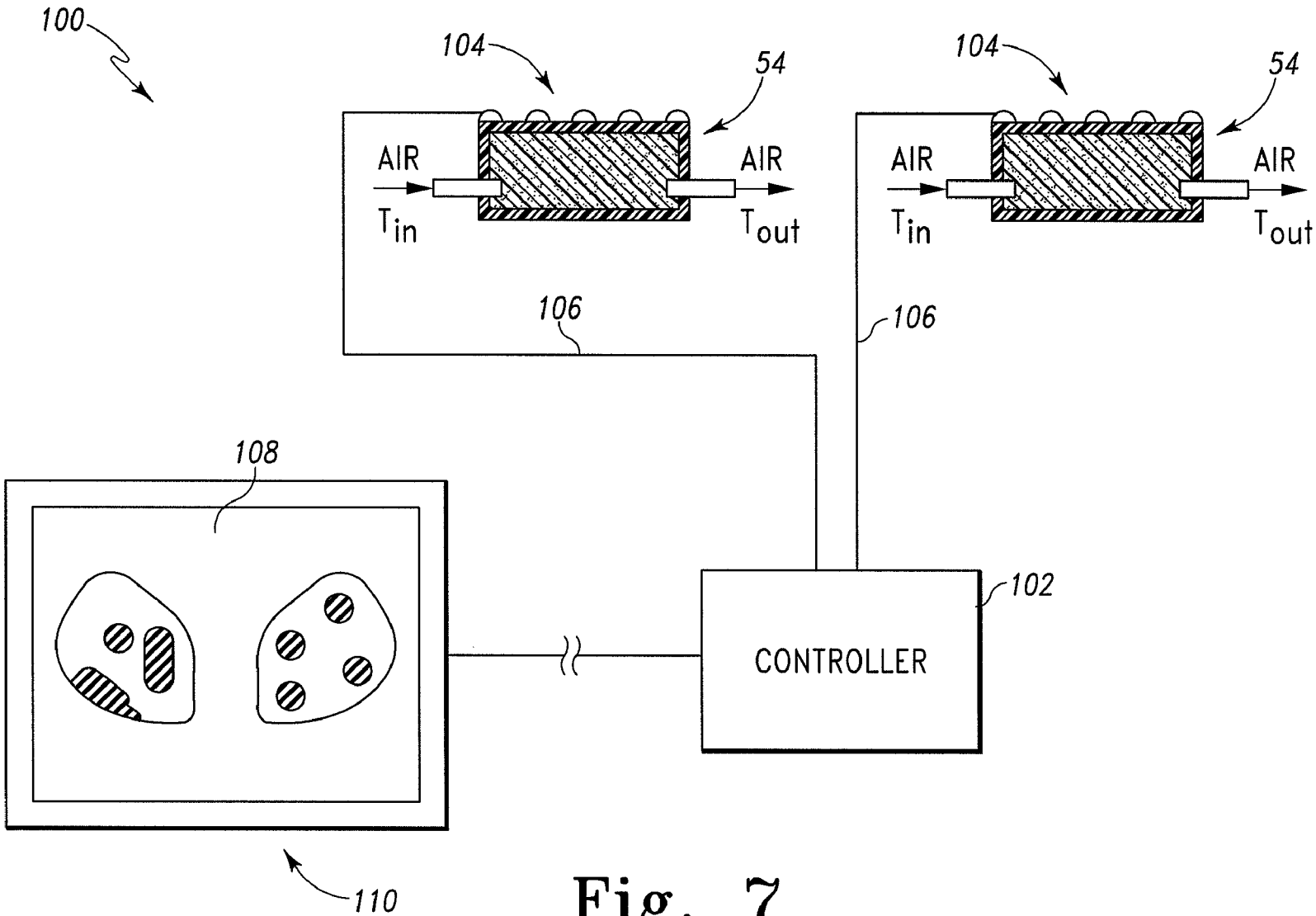
FIG. 7 is a diagrammatic view showing an apparatus to monitor and control one or more parameters, such as the temperature, humidity, pressure, and the like, affecting a patient's skin during long surgeries.

FIG. 7 diagrammatically shows an apparatus 100 to monitor and control one or more parameters affecting the integrity of a patient's skin, such as, for example, the variables listed above. As shown in FIG. 7, a controller 102 is coupled to a plurality of sensors 104 located on a pair of patient supports 54. The sensors 104 measure one or more parameters affecting the integrity of a patient's skin and transmit the data to the controller 102 over wires 106. In the illustrated embodiment, the controller 102 controls a patient's skin temperature by controlling the temperature $T_{in}$ of the air supplied to the patient supports 54 and $T_{out}$ of the air leaving the patient supports 54. In some embodiments, the controller 102 processes the data and maps the results, for example, temperature, on the screen 108 of a display 110 coupled to the controller 102. In other embodiments, the controller 102 uses the data supplied by the sensors 104 to control one or more parameters, such as the pressure exerted by the patient support 54 on a patient's skin, as shown, for example, in FIGS. 8-10. Thus, the controller 102 may vary the pressure in individual bladders that form the patient support 54 to control the pressure exerted by the patient support 54 on a patient's skin. In still other embodiments, the controller 102 may be configured to activate an alarm (not shown) when the monitored parameter, such as the temperature, pressure, humidity, is greater than, greater than or equal to, less than, or less than or equal to a threshold value. In some embodiments, the controller 102 may be configured to activate the alarm when the monitored parameter, such as the temperature, pressure, humidity, is outside first and second threshold values.

Figure 13:
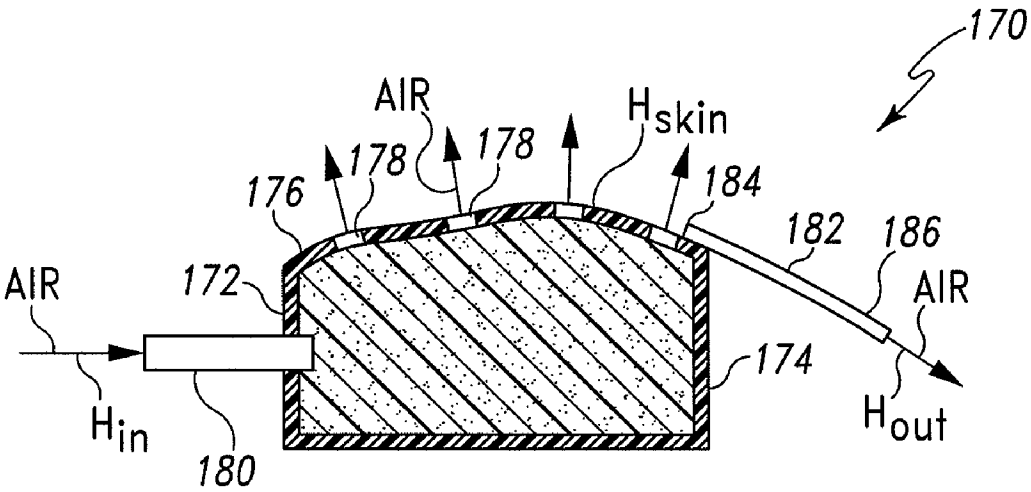
FIG. 13 is a side elevation view, similar to FIG. 12, of a localized patient support showing the air entering the patient support through an inlet on a first side thereof and exiting the patient support through a plurality of openings in an upwardly-facing low air loss patient support surface thereof and showing a tube having an opening located near the upwardly-facing low air loss patient support surface to draw moisture away from a patient's skin.
Figure 14:
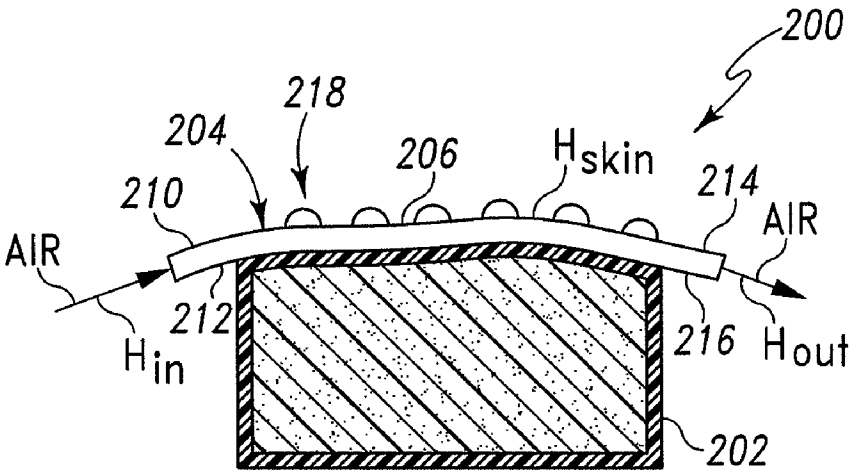
FIG. 14 is a side elevation view of a localized patient support showing a patient support pad supported above a base, and showing air entering the pad through an inlet on a first side thereof and exiting the pad through an outlet on a second side thereof to draw moisture away from a patient's skin.
Figure 15:
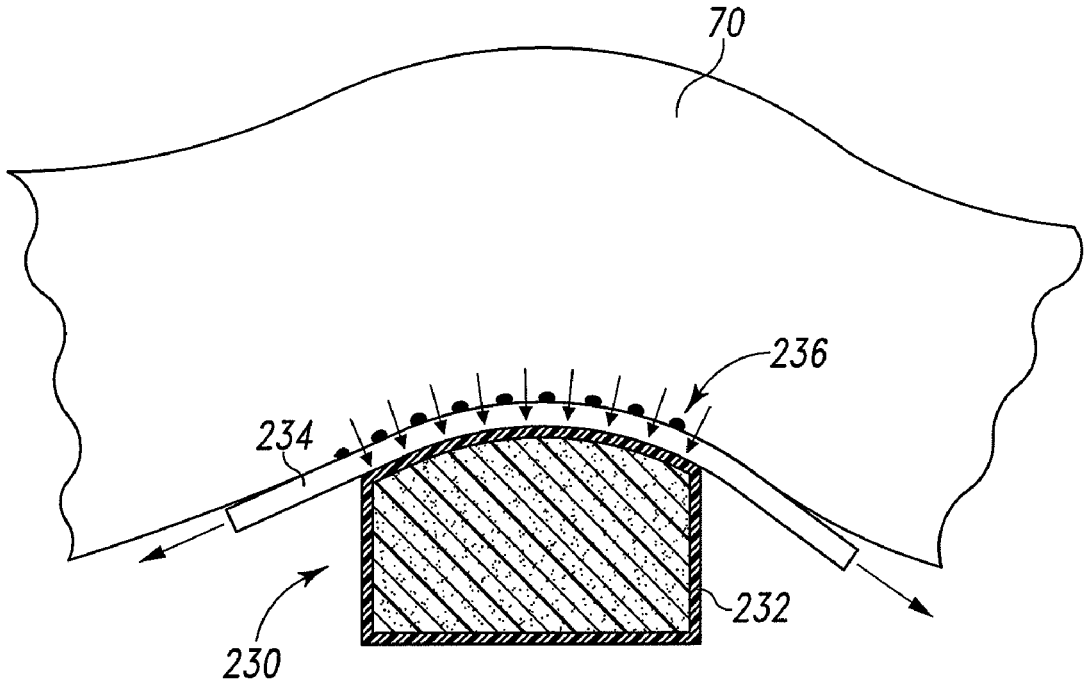
FIG. 15 is a side elevation view of a localized patient support showing a hydrophilic patient support pad supported above a base to draw moisture away from a patient's skin.
Figure 16:
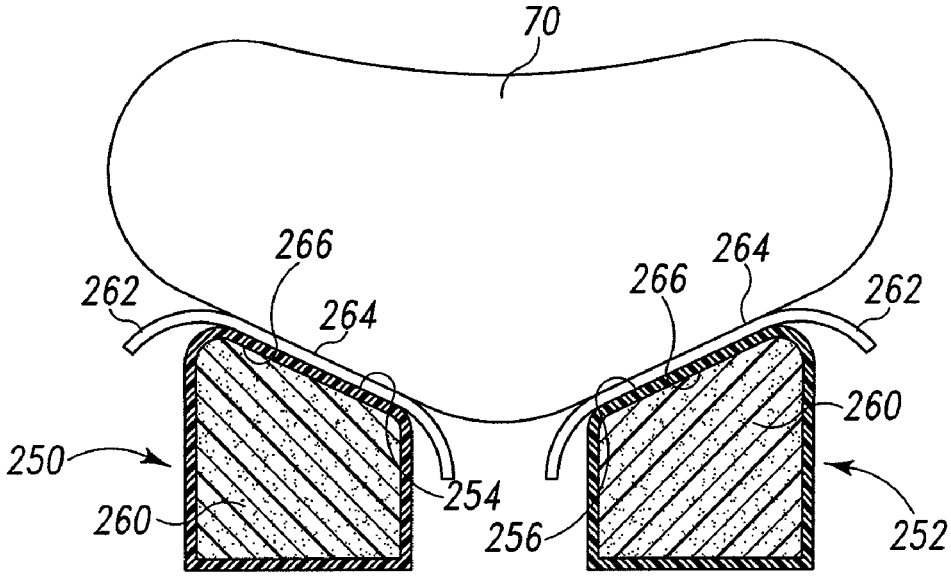
FIG. 16 is an end elevation view of a pair of oppositely-inclined localized patient supports and a pair of rolling sheets to be disposed between a patient and each of the oppositely-inclined patient supports, the rolling sheets having a bottom surface of a relatively low friction and a top surface of a relatively high friction.
Figure 17:
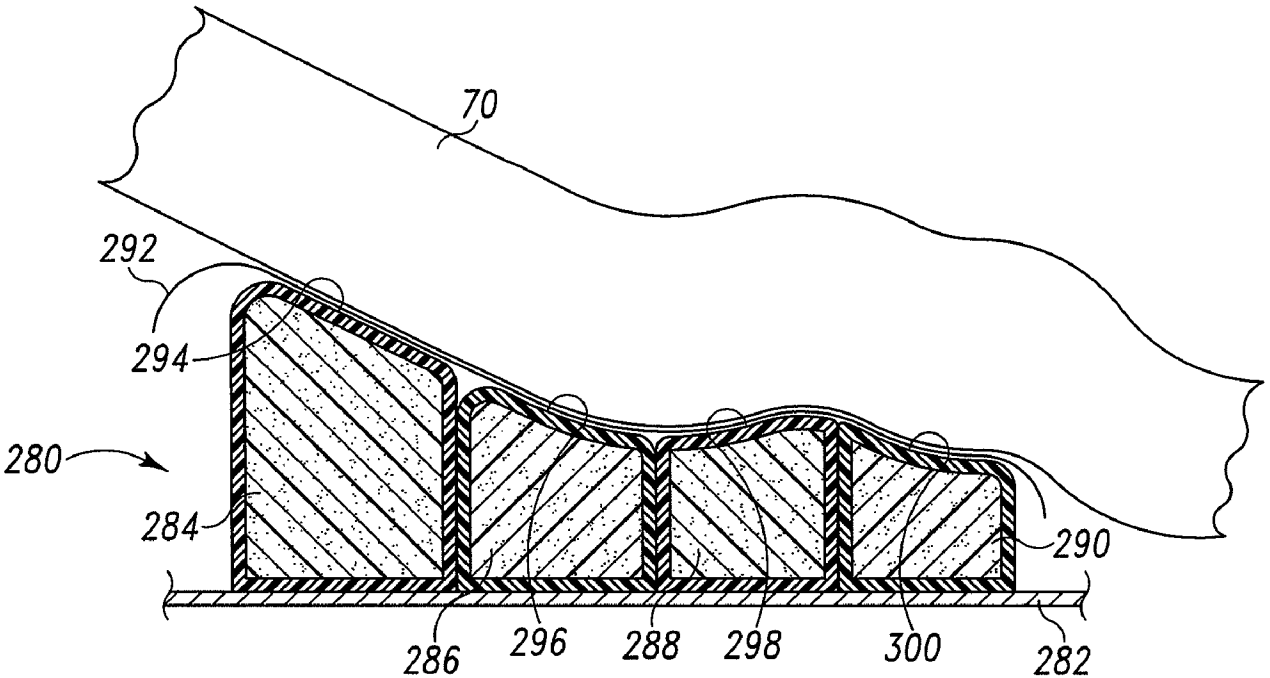
FIG. 17 is a side elevation view of a localized patient support showing a base, a plurality of foam blocks extending upwardly from the base, and a rolling sheet to be disposed between a patient and the top surfaces of the foam blocks.
Figure 18:
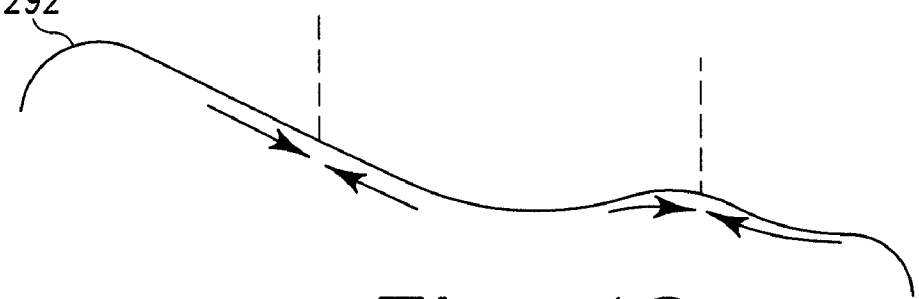
FIG. 18 is a view showing the shear forces exerted on a patient's skin by the patient support of FIG. 17.
Figure 19:
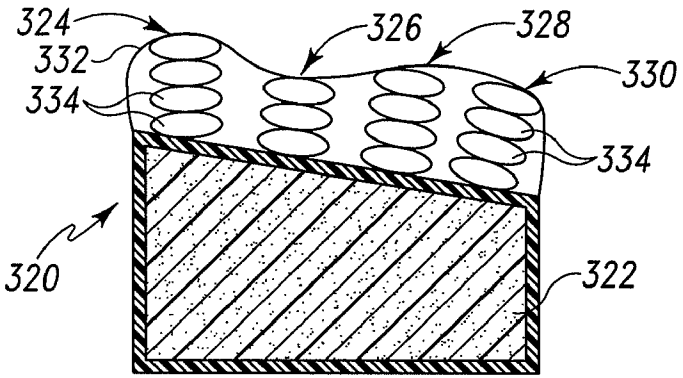
FIG. 19 is a side elevation view of a localized patient support showing the patient support having a foam base, a plurality of vertically-stacked adjustable bladders supported above the foam base, and a cover enclosing the plurality of vertically-stacked adjustable bladders.
Figure 20:
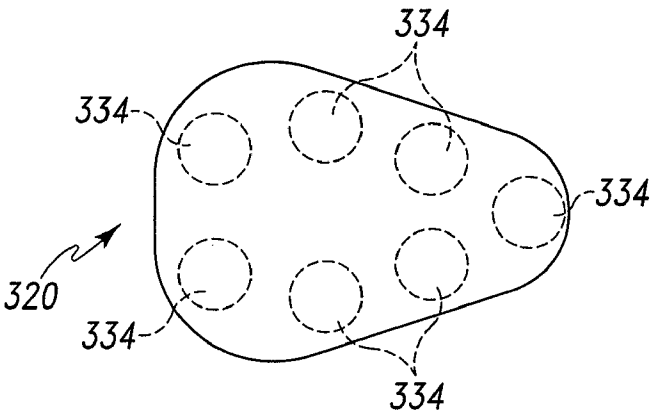
FIG. 20 is a top view of the patient support of FIG. 19 with the cover removed showing the plurality of vertically-stacked adjustable bladders.
Figure 21:
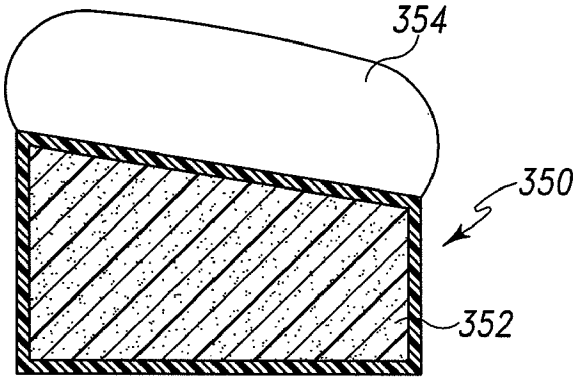
FIG. 21 is a side elevation view of a localized patient support showing the patient support having a foam base and a single adjustable bladder supported above the foam base.
Figure 22:
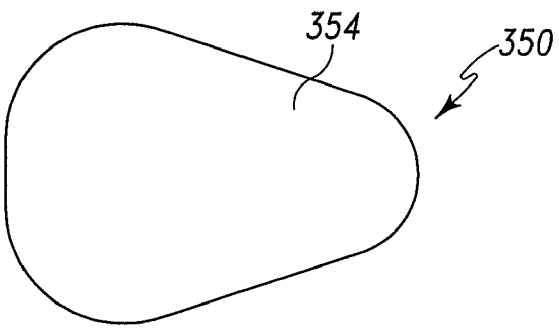
FIG. 22 is a top view of the patient support of FIG. 21 showing the single adjustable bladder.
Figure 23:
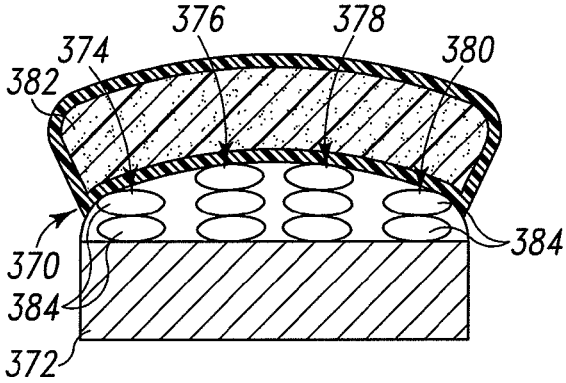
FIG. 23 is a side elevation view of a localized patient support showing the patient support having a base, a plurality of vertically-stacked adjustable bladders supported above the base, and a foam layer supported above the vertically-stacked adjustable bladders.
Figure 25:
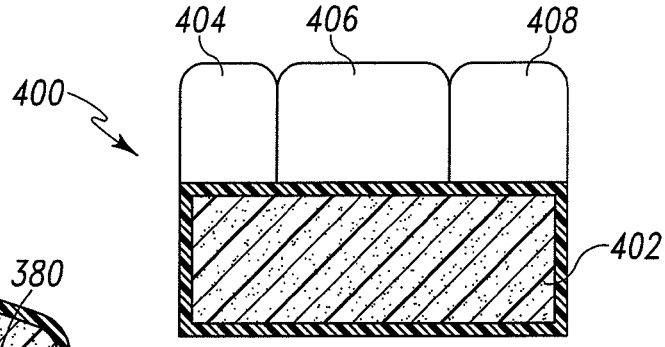
FIG. 25 is a side elevation view of a localized patient support showing the patient support including a foam base and a plurality of bladders supported above the foam base, with the bladders providing a segmented upwardly-facing patient support surface.
Figure 24:
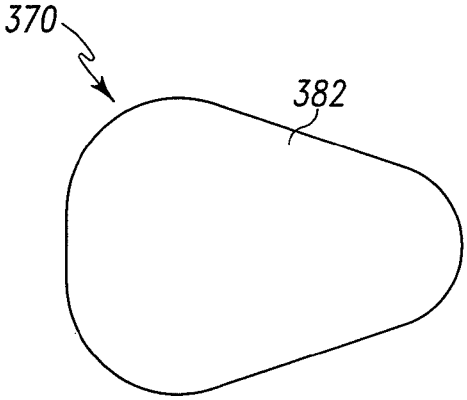
FIG. 24 is a top view of the patient support of FIG. 23 showing the top foam layer.
Figure 26:
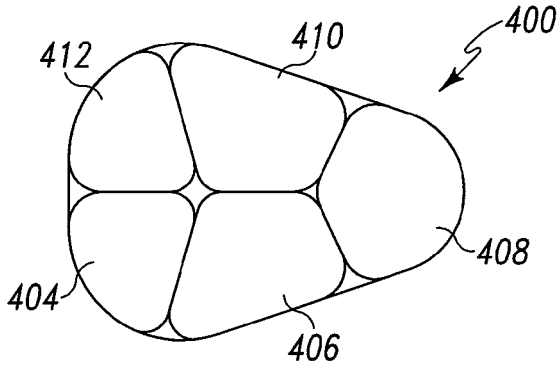
FIG. 26 is a top view of the patient support of FIG. 25 showing the segmented patient support surface.
Figure 27:
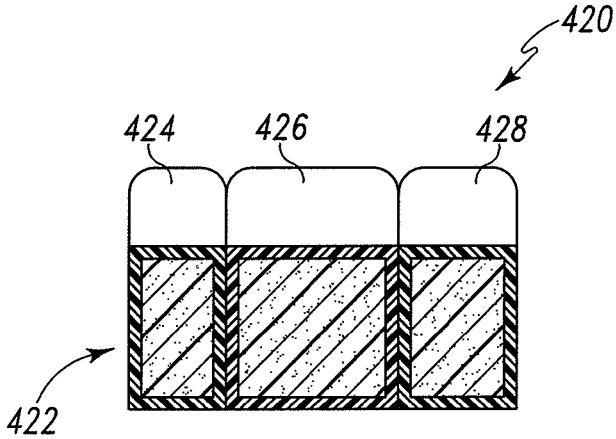
FIG. 27 is a side elevation view, similar to FIG. 25, of a localized patient support showing the patient support including a segmented foam base and a plurality of bladders supported above the segmented foam base, with the bladders providing a segmented patient support surface.
Figure 30:
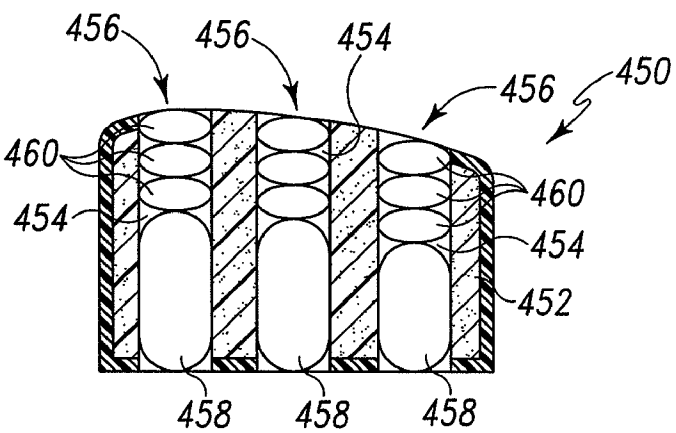
FIG. 30 is a side elevation view of a localized patient support showing the patient support including a foam base having a plurality of bores and a plurality of vertically-stacked adjustable bladders in the associated bores.
Figure 31:
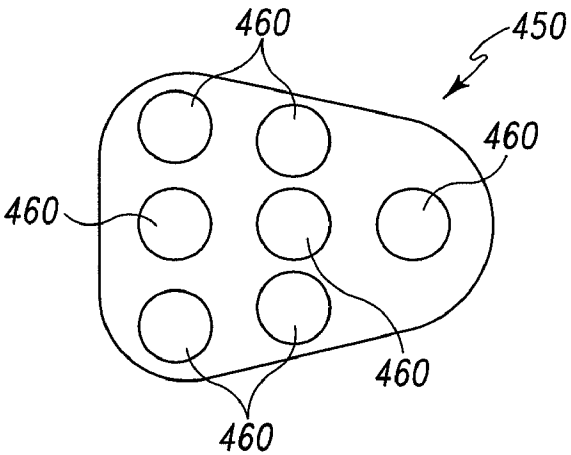
FIG. 31 is a top view of the patient support of FIG. 30 showing plurality of vertically-stacked adjustable bladders.
Figure 28:
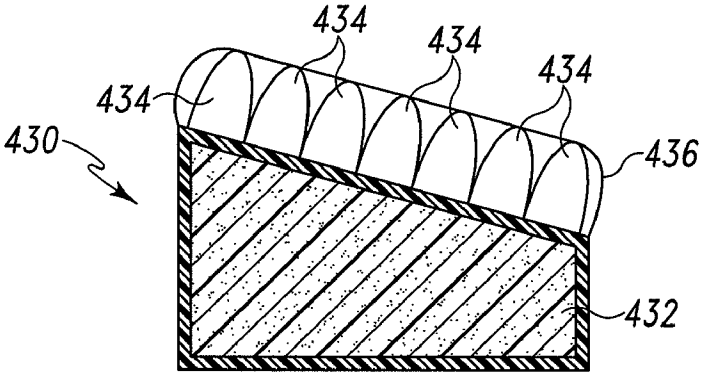
FIG. 28 is a side elevation view of a localized patient support showing the patient support including a foam base, a plurality of vertically-extending adjustable bladders supported above the foam base, and a cover enclosing the bladders.
Figure 29:
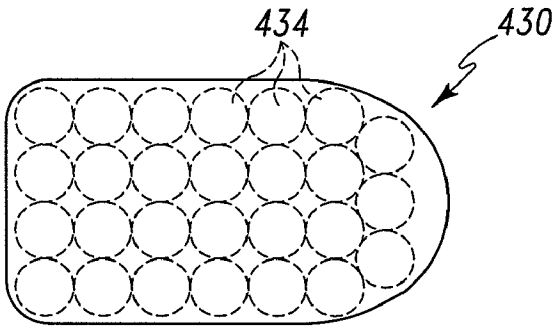
FIG. 29 is a top view of the patient support of FIG. 28 with the cover removed showing the plurality of adjustable bladders.
Figure 34:
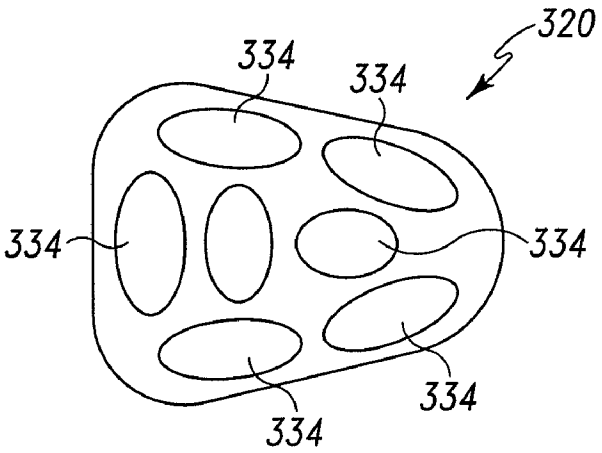
FIG. 34 is a top view of a localized patient support having a perimeter pattern of bladders and an inner pattern of bladders.
Figure 32:
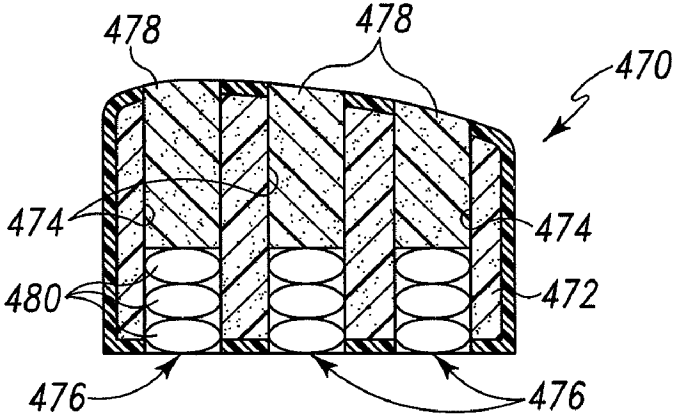
FIG. 32 is a side elevation view of a localized patient support showing the patient support including a foam base having a plurality of bores, a plurality of vertically-stacked adjustable bladders in the bores, and a plurality of foam inserts supported above the vertically-stacked adjustable bladders.
Figure 33:
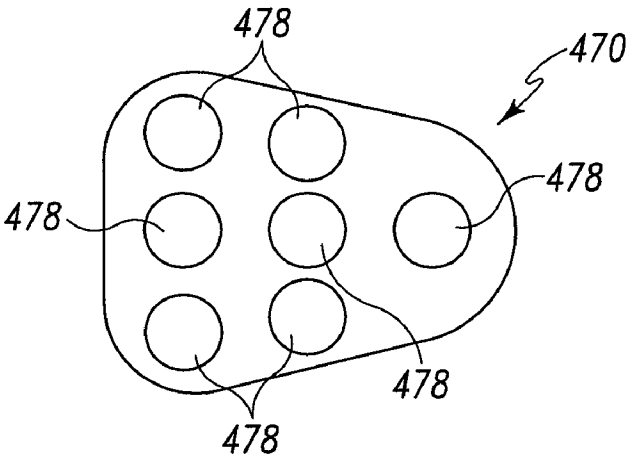
FIG. 33 is a top view of the patient support of FIG. 32 showing the plurality of foam inserts.
Figure 36:
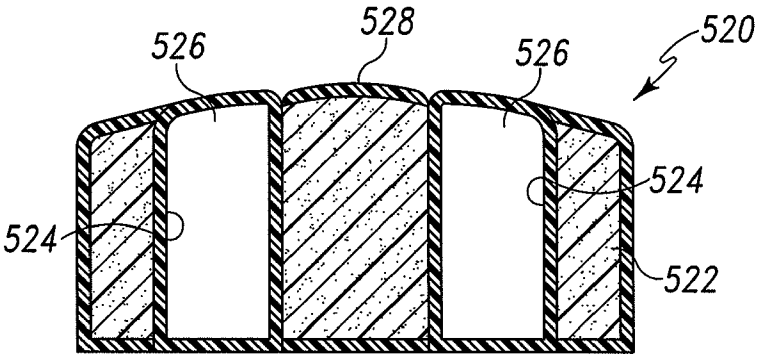
FIG. 36 is a side elevation view of a localized patient support showing the patient support having a plurality of vertically-extending adjustable bladders arranged in a pattern and a plurality of foam inserts located between the plurality of vertically-extending adjustable bladders.
Figure 37:
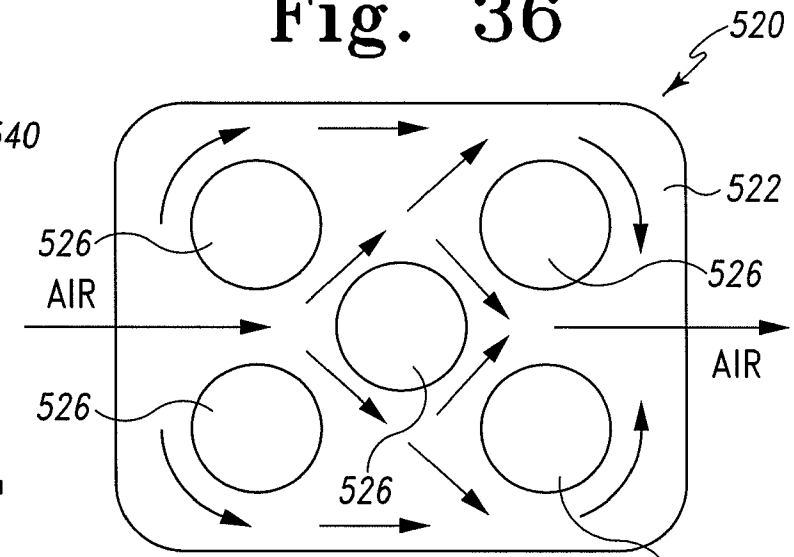
FIG. 37 is a top view of the patient support of FIG. 36 showing the air flowing around the vertically-extending adjustable bladders.
Figure 35:
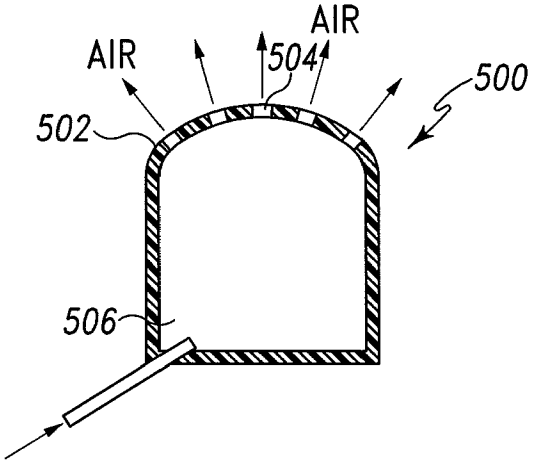
FIG. 35 is a side elevation view of a localized patient support showing air entering the patient support near a bottom portion thereof and exiting the localized patient support through a plurality of openings in an upwardly-facing patient support surface thereof.
Figure 38:
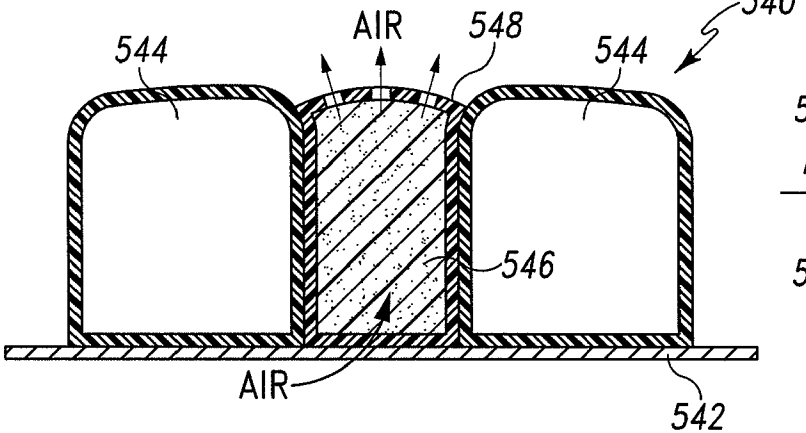
FIG. 38 is a side elevation view, similar to FIG. 36, of a localized patient support showing the air exiting the top surfaces of the foam inserts after circulating around the vertically-extending adjustable bladders.
Figure 47:
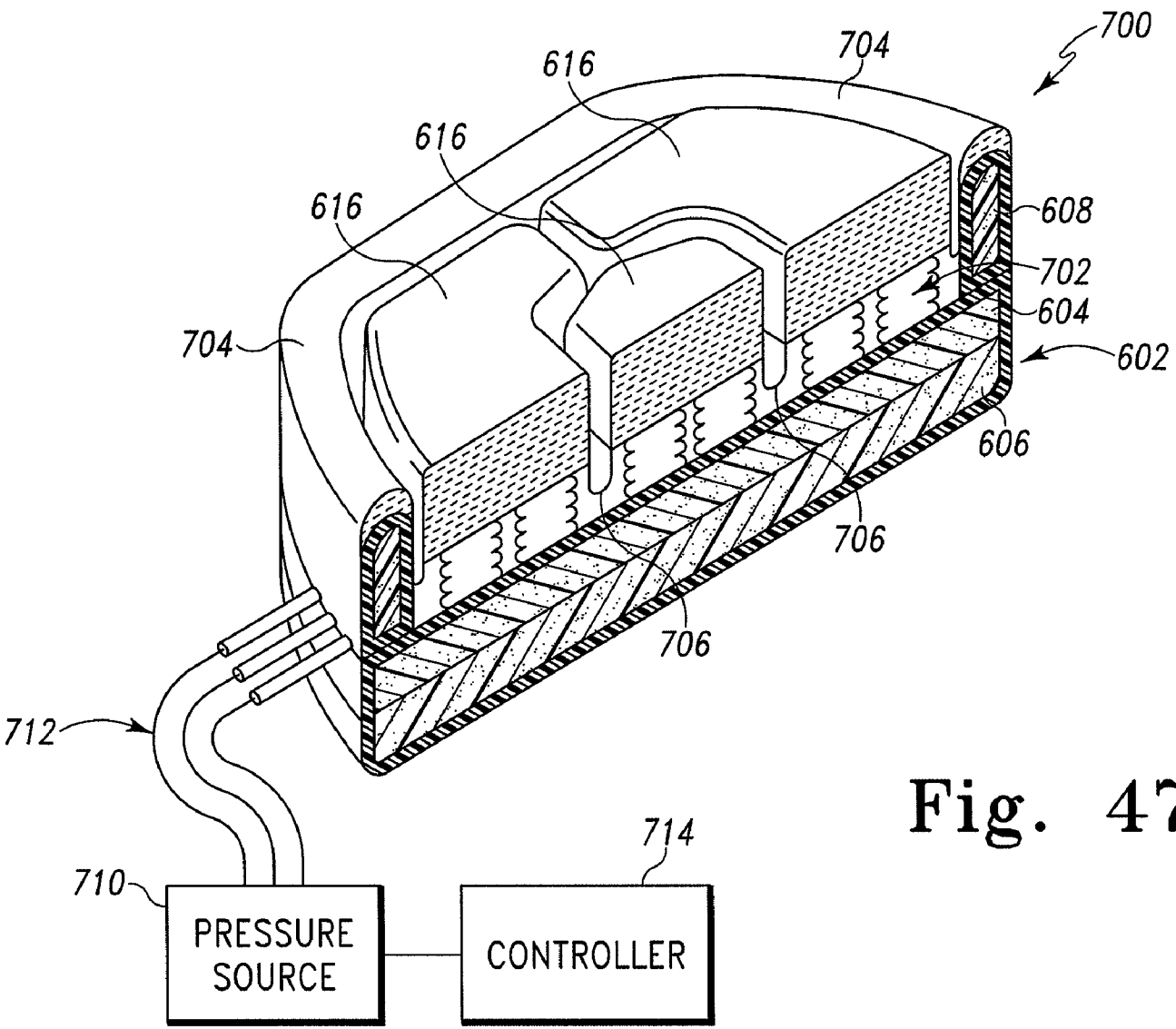
FIG. 47 is a sectional perspective view of another embodiment of a localized patient support similar to the patient support shown in FIGS. 43-46, except that the foam insert is replaced with a plurality of air bladders and except that the gel pad has a relatively thin annular portion or lip overlying the annular foam ring.
Figure 48:
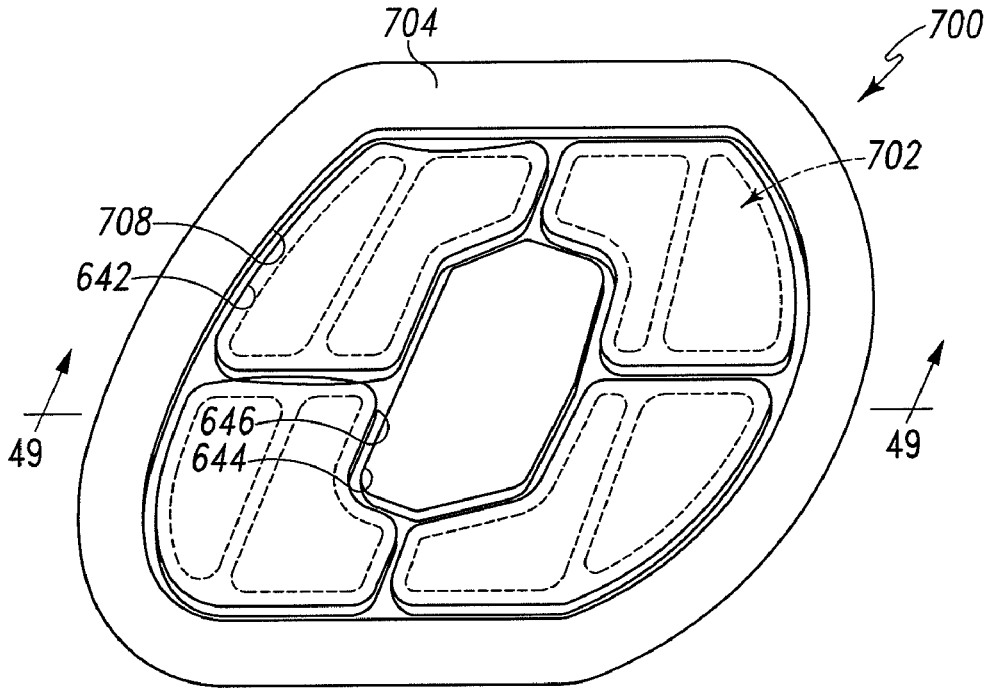
FIG. 48 is a top plan view of the patient support of FIG. 47.
Figure 49:
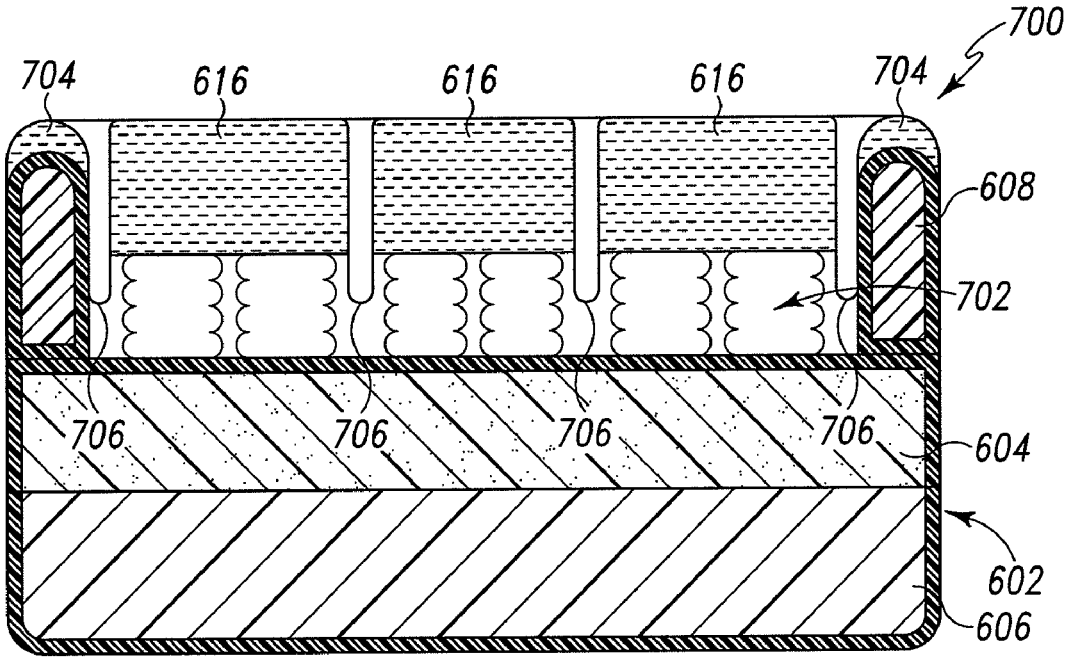
FIG. 49 is a cross sectional view of the patient support of FIGS. 47-48 along a line 49-49 in FIG. 48.
Figure 62:
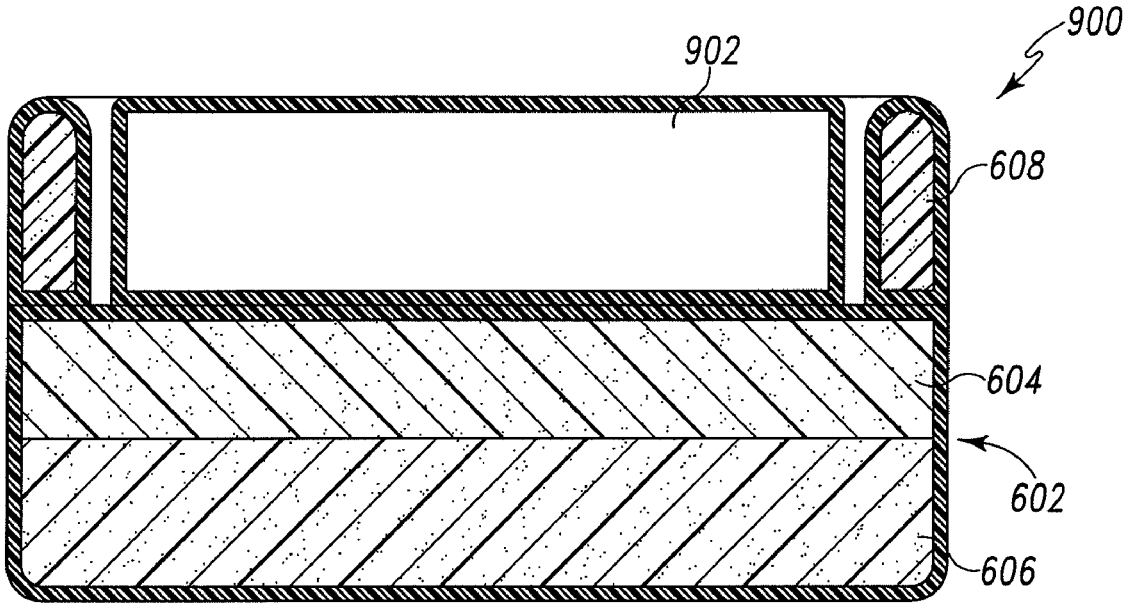
FIG. 62 is a cross sectional view of still another embodiment of a localized patient support similar to the patient support shown in FIGS. 43-46, except that the foam insert and the sectioned gel pad are replaced with a single air bladder received in the cavity.
Figure 63:
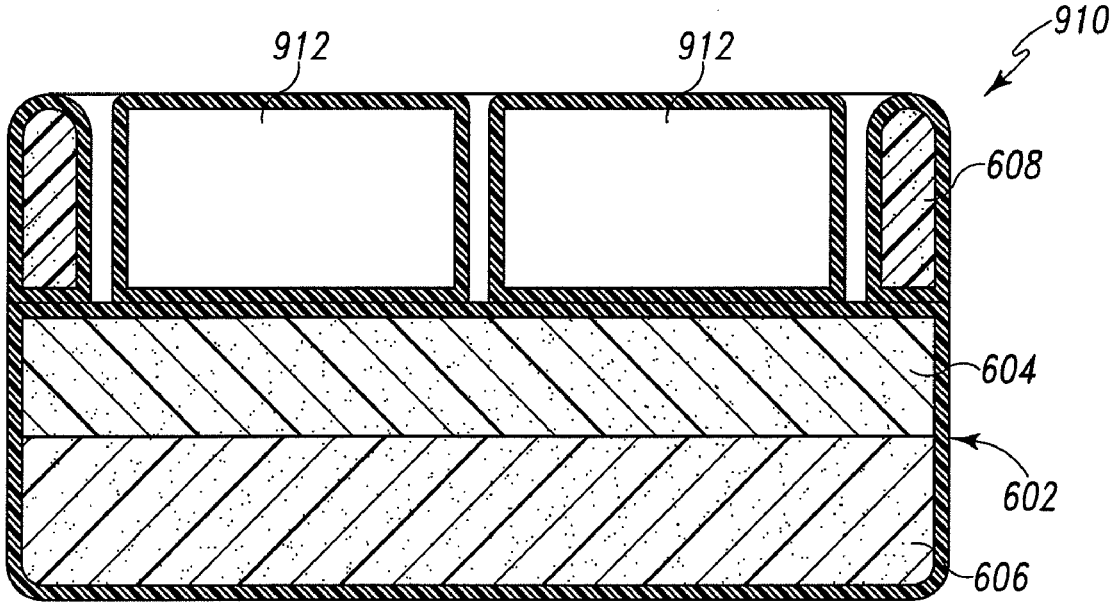
FIG. 63 is a cross sectional view of yet another embodiment of a localized patient support similar to the patient support shown in FIG. 62, except that the single air bladder is replaced with multiple air bladders received in the cavity.
Figure 64:
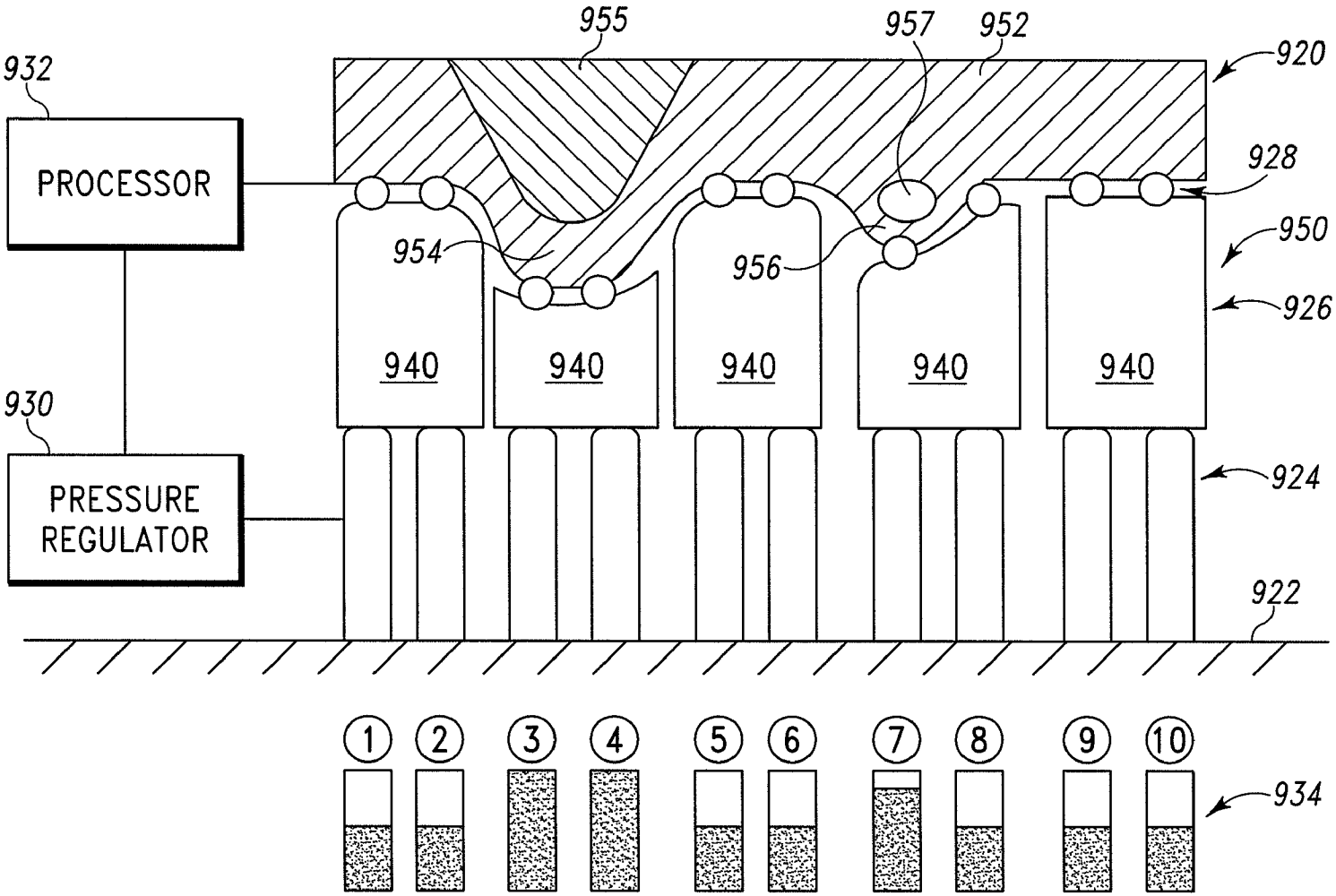
FIGS. 64-66 diagrammatically show a pressure control system comprising a base, a plurality of vertically-adjustable air bladders extending upwardly from the base, a sectioned gel pad supported above the bladders, a plurality of pressure sensors coupled to the gel pad, a pressure regulator coupled to the air bladders, and a signal processor coupled to the pressure sensors and coupled to the air bladders.
Figure 65:
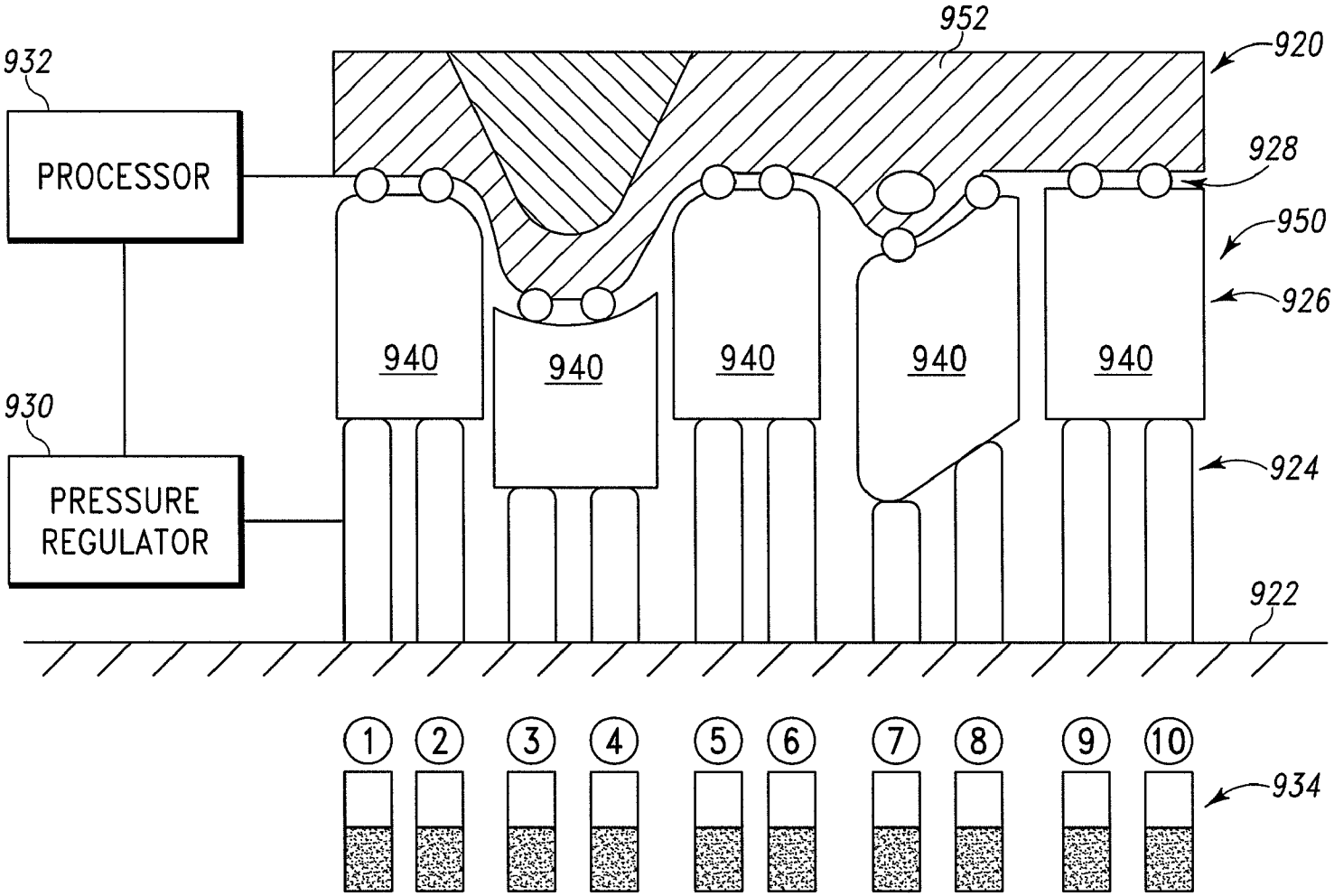
Figure 66:
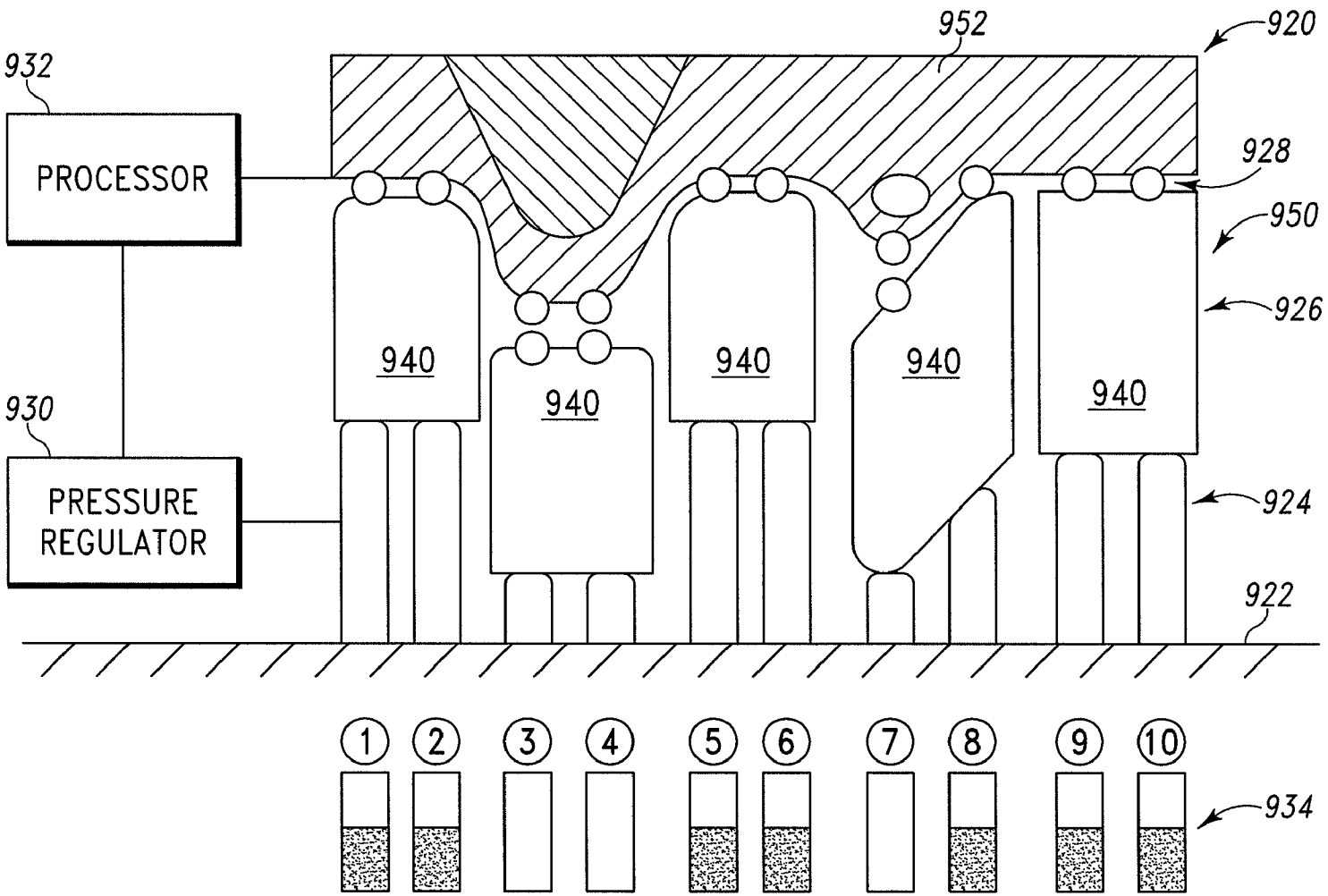

The apparatus 100 shown in FIG. 7 is suitable for use with a plurality of localized patient supports shown in FIGS. 11-55 and 62-66. FIG. 11 illustrates a patient support 120. FIG. 12 illustrates a patient support 150. FIG. 13 illustrates a patient support 170. FIG. 14 illustrates a patient support 200. FIG. 15 illustrates a patient support 230. FIG. 16 illustrates patient supports 250, 252. FIGS. 17-18 illustrate a patient support 280. FIGS. 19-20 illustrate a patient support 320. FIGS. 21-22 illustrate a patient support 350. FIGS. 23-24 illustrate a patient support 370. FIGS. 25-26 illustrate a patient support 400. FIG. 27 illustrates a patient support 420. FIGS. 28-29 illustrate a patient support 430. FIGS. 30-31 illustrate a patient support 450. FIGS. 32-33 illustrate a patient support 470. FIG. 34 illustrates an alternate configuration of the patient supports 320. FIG. 35 illustrates a patient support 500. FIGS. 36-37 illustrate a patient support 520. FIG. 38 illustrates a patient support 540. FIGS. 39-42 illustrate different arrangements of sensors 560, 570, 580, and 590. FIGS. 43-46 illustrate a patient support 600. FIGS. 47-49 illustrate a patient support 700. FIGS. 50-55 illustrate a patient support 800. FIG. 62 illustrates a patient support 900. FIG. 63 illustrates a patient support 910. FIGS. 64-66 illustrate a patient support 950.

As shown in FIG. 11, a localized patient support 120 has a first side 122, a second side 124, an upwardly-facing patient support surface 126, an inlet 128 on the first side 122 through which air, at temperature $T_{in}$, enters the patient support 120, an outlet 130 on the second side 124 through which the air, at temperature $T_{out}$, exits the patient support 120. In some embodiments, the patient support 120 includes a plurality of sensors 132 to measure the temperature $T_{skin}$ on the surface 126 near a patient's skin. In such embodiments, the system 100 may be configured to vary the temperatures $T_{in}$ and/or $T_{out}$ to keep $T_{skin}$ within a specified range. The patient support 120 may comprise one or more foam elements and/or one or more adjustable or inflatable bladders or cells. The term "foam" as used in the specification and claims means a resilient material that is compressed under pressure and is capable of returning to its original configuration upon removal of pressure therefrom.

As shown in FIG. 12, a localized patient support 150 includes an upwardly-facing low air loss patient support surface 152 having a plurality of openings 154 and an inlet 156 on a first side 158 thereof. Air, at temperature $T_{in}$, enters the patient support 150 through the inlet 156 and exits the patient support 150 through the plurality of openings 154 in the upwardly-facing surface 152. In some embodiments, the patient support 150 includes a plurality of sensors 160 to measure the temperature $T_{skin}$ of the surface 152 near a patient's skin. In such embodiments, the system 100 may be configured to vary the temperatures $T_{in}$ to keep $T_{skin}$ within a specified range. The patient support 150 may comprise one or more foam elements and/or one or more adjustable bladders.

As shown in FIG. 13, a localized patient support 170 includes a first side 172, a second side 174, an upwardly-facing low air loss patient support surface 176 having a plurality of openings 178, and an inlet 180 on the first side 172. Air, at relative humidity $H_{in}$ %, enters the patient support 170 through the inlet 180 and exits the patient support 170 through the plurality of openings 178 in the upwardly-facing low air loss patient support surface 176. The patient support 170 includes a tube 182 having an inlet 184 thereof located near the upwardly-facing patient support surface 176 so that a portion of the air near a patient's skin is diverted to the surrounding atmosphere through the tube 182. In some embodiments, the patient support 170 includes a sensor 186 coupled to the tube 182 to measure the relative humidity $H_{skin}$ % near a patient's skin. In such embodiments, the system 100 may be configured to vary the relative humidity $H_{in}$ % to keep relative $H_{skin}$ % within a specified range. The patient support 170 may comprise one or more foam elements and/or one or more adjustable bladders.

As shown in FIG. 14, a localized patient support 200 includes a base 202 and a relatively thin patient support pad 204 to be disposed between the patient and a top surface of the base 202. The patient support pad 204 has an outer surface 206 defining an interior region 208, an inlet 210 on a first side 212 thereof and an outlet 214 on a second side 216 thereof. Moisture from a patient's skin passes through the outer surface 206 into the interior region 208 of the patient support pad 204. Air enters the interior region 208 of the patient support pad 204 through the inlet 210 and exits the patient support pad 204 through the outlet 214 to draw moisture away from a patient's skin. In some embodiments, the patient support 200 includes a plurality of sensors 218 located on an upwardly-facing portion of the outer surface 206 to measure the relative humidity $H_{skin}$ % near a patient's skin. In such embodiments, the system 100 may be configured to vary the relative humidity $H_{in}$ % of the air entering the patient support pad 200 to keep relative $H_{skin}$ % within a specified range. The base 202 may comprise one or more foam elements and/or one or more adjustable bladders.

As shown in FIG. 15, a localized patient support 230 includes a base 232 and a relatively thin hydrophilic patient support pad 234 to be disposed between the patient and a top surface of the base 232. The hydrophilic pad 234 draws moisture away from a patient's skin. In some embodiments, the patient support 230 includes a plurality of sensors 236 located thereon to measure the relative humidity $H_{skin}$ % near a patient's skin. In such embodiments, the system 100 may be configured to vary the relative humidity $H_{in}$ % of the air blowing over the patient support pad 230 to keep relative $H_{skin}$ % within a specified range. The base 232 may comprise one or more foam elements and/or one or more adjustable bladders.

As shown in FIG. 16, a pair of oppositely-disposed localized patient supports 250, 252 support a portion of a patient's body, such as a pelvis region, or a chest region. The two patient supports 250, 252 have upwardly-facing surfaces 254, 256 which are inclined in opposite directions to counterbalance the shear forces exerted by the patient supports 250, 252 on a patient's body. Each patient support 250, 252 includes a base 260 and a rolling sheet 262 to be disposed between the patient and the upwardly-facing surface 254, 256 of the associated patient support 250, 252. Each rolling sheet 262 has a top surface 264 of relatively high friction facing the patient and a bottom surface 266 of relatively low friction facing the base 260. The base 260 may comprise one or more foam elements and/or one or more adjustable bladders.

As shown in FIG. 17, a localized patient support 280 includes a base 282, a plurality of foam blocks 284, 286, 288, 290 extending upwardly from the base 282, and a rolling sheet 292 to be disposed between the patient and upwardly-facing surfaces 294, 298, 298, 300 of the associated foam blocks 284, 286, 288, 290. The heights of the foam blocks 284, 286, 288, 290, the inclinations of the upwardly-facing surfaces 294, 298, 298, 300, and the contours of the upwardly-facing surfaces 294, 296, 298, 300 are selected so that the shear forces exerted by the rolling sheet 292 on a patient's skin have a desirable distribution as shown in FIG. 18. In some embodiments, a plurality of bladders is used instead of the foam blocks 284, 286, 288, 290. In some other embodiments, the foam blocks 284, 286, 288, 290 may be replaced by a combination of bladders and foam elements.

As shown in FIG. 19, a localized patient support 320 includes a base 322, a plurality of vertically-stacked adjustable bladders 324, 326, 328, 330 extending upwardly from the base 322, and a cover 332 enclosing the plurality of vertically-stacked bladders 324, 326, 328, 330. Each vertical stack or column of the bladders 324, 326, 328, 330 comprises individual micro-bladders 334 which are attached to adjacent micro-bladders 334 to form the vertical stack. The lowermost micro-bladder 334 is attached to the base 322. In the illustrated embodiment, the micro-bladders 334 are made from relatively inelastic vinyl material. The arrangement of the vertically-stacked bladders 324, 326, 328, 330 relative to the base 322, the height of the vertically-stacked bladders 324, 326, 328, 330, and the pressures in the individual micro-bladders 336 are selected to control the pressure and the shear forces exerted by the patient support 320 on a patient's skin. In some embodiments, the apparatus 100 may be configured to vary the pressures in individual micro-bladders 334 to control the pressure and the shear forces exerted by the patient support 320 on a patient's skin. In other embodiments, the micro-bladders 334 in a vertical stack may be interconnected so that all the micro-bladders 334 in a vertical stack have the same pressure. The base 322 may comprise one or more foam elements and/or one or more adjustable bladders. FIGS. 20 and 34 show different arrangements of the vertically-stacked bladders 324, 326, 328, 330 relative to the base 322.

As shown in FIG. 21, a localized patient support 350 has a foam base 352 and a single adjustable bladder 354 supported above the foam base 352. The base 352 may comprise one or more foam elements and/or one or more adjustable bladders. In some embodiments, the apparatus 100 may be configured to vary the pressures in the bladder 354 to control the pressure and the shear forces exerted by the patient support 350 on a patient's skin. FIG. 22 is a plan view of the patient support 350. In the illustrated embodiment, the bladder 354 is made from relatively inelastic vinyl material.

As shown in FIG. 23, a localized patient support 370 has a relatively firm base 372, a plurality of vertically-stacked adjustable bladders 374, 376, 378, 380 extending upwardly from the base 372, and a foam layer 382 supported above the vertically-stacked adjustable bladders 374, 376, 378, 380. Each vertical stack or column of the bladders 374, 376, 378, 380 comprises a plurality of individual micro-bladders 384 which are attached to adjacent micro-bladders 384 to form the vertical stack. The lowermost micro-bladder 384 is attached to the base 372. In the illustrated embodiment, the micro-bladders 384 are made from relatively inelastic vinyl material. The arrangement of the vertically-stacked bladders 374, 376, 378, 380 relative to the base 372, the height of the vertically-stacked bladders 324, 326, 328, 330, the pressures in the individual micro-bladders 336, the indentation load deflection ("ILD") value of the foam layer 382 are selected to control the pressure and the shear forces exerted by the patient support 370 on a patient's skin. In some embodiments, the apparatus 100 may be configured to vary the pressures in individual micro-bladders 384 to control the pressure and the shear forces exerted by the patient support 320 on a patient's skin. FIG. 24 is a top view of the localized patient support of FIG. 23 showing the top foam layer;

As shown in FIG. 25, a localized patient support 400 includes a foam base 402 and a plurality of bladders 404, 406, 408, 410, 412 extending upwardly from the base 402. The downwardly-facing surfaces of the bladders 404, 406, 408, 410, 412 are attached to the base 402. The upper ends of the adjacent bladders 404, 406, 408, 410, 412 are interconnected to provide a segmented patient support surface as shown in FIG. 26. The arrangement of the bladders 404, 406, 408, 410, 412 relative to the base 402, the height of the bladders 404, 406, 408, 410, 412, the pressures in the bladders 404, 406, 408, 410, 412, the ILD value of the foam base 402 are selected to control the pressure and the shear forces exerted by the patient support 400 on a patient's skin. In some embodiments, the apparatus 100 may be configured to vary the pressures in the bladders 404, 406, 408, 410, 412 to control the pressure and the shear forces exerted by the patient support 400 on a patient's skin. FIG. 27 shows another embodiment 420 of the patient support 400. As shown in FIG. 27, the patient support 420 includes a segmented foam base 422 and a plurality of bladders 424, 426, 428 extending upwardly from the segmented foam base 422.

As shown in FIG. 28, a localized patient support 430 includes a foam base 432, a plurality of adjustable bladders 434 extending upwardly from the foam base 432, and a cover 436 enclosing the bladders 434. The downwardly-facing surfaces of the bladders 434 are attached to the base 432. In the illustrated embodiment, the bladders are made from relatively inelastic vinyl material. The arrangement of the bladders 434 relative to the base 432, the height of the individual bladders 434, the pressures in the individual bladders 434, the ILD value of the foam base 432 are selected to control the pressure and the shear forces exerted by the patient support 430 on a patient's skin. In some embodiments, the apparatus 100 may be configured to vary the pressures in the individual bladders 434 to control the pressure and the shear forces exerted by the patient support 430 on a patient's skin. FIG. 29 is a top view of the patient support 430 with the cover 436 removed.

As shown in FIG. 30, a localized patient support 450 includes a foam base 452 having a plurality of bores 454 and a plurality of vertically-stacked adjustable bladders 456 located in the bores 454. Each vertical stack or column of vertically-stacked bladders 456 includes a relatively tall bladder 458 and a plurality of micro-bladders 460. The adjacent bladders 458, 460 in a vertical stack are interconnected. The arrangement of the bladders 456 relative to the base 452, the height of the individual bladders 458, 460, the pressures in the individual bladders 458, 460, the ILD value of the foam base 452 are selected to control the pressure and the shear forces exerted by the patient support 450 on a patient's skin. In some embodiments, the apparatus 100 may be configured to vary the pressures in the individual bladders 458, 460 to control the pressure and the shear forces exerted by the patient support 450 on a patient's skin. FIG. 31 shows an arrangement of the bladders 456 relative to the base 452. FIGS. 32 and 33 show another embodiment 470 of the patient support 450. As shown in FIGS. 32 and 33, the patient support 470 includes a foam base 472 having a plurality of bores 474, a plurality of vertically-stacked adjustable bladders 476 located in the bores 474, and a plurality of foam inserts 478 supported above the vertically-stacked adjustable bladders 476. Each stack 478 of the vertically-adjustable bladders includes a plurality of micro-bladders 480.

As shown FIG. 35, a localized patient support 500 comprises a single bladder including an upwardly-facing patient support surface 502 having a plurality of openings 504. Air enters the bladder 500 near a bottom portion 506 thereof and exits the bladder 500 through the plurality of openings 504 in the upwardly-facing surface 502. In some embodiments, the apparatus 100 may be configured to vary the pressure in the bladder 500 to control the pressure and the shear forces exerted by the bladder 500 on a patient's skin. In other embodiments, the apparatus 100 maybe configured to vary the temperature $T_{in}$ of the air entering the bladder 500 to control the temperature at a patient's skin. In still other embodiments, the apparatus 100 may be configured to vary the relative humidity $H_{in}$ % of the air entering the bladder 500 to control the relative humidity at a patient's skin. In yet other embodiments, the apparatus 100 may be configured to vary the pressure in the bladder 500 and the temperature $T_{in}$ and the relative humidity $H_{in}$ % of the air entering the bladder 500.

As shown in FIG. 36, a localized patient support 520 includes a foam base 522 having a plurality of bores 524 and a plurality of adjustable bladders 526 received in the bores 524 and arranged in a pattern shown in FIG. 37. In the embodiment illustrated in FIGS. 36 and 37, air circulates around the bladders 526, but does not escape through a top surface 528 of the foam base 522. FIG. 38 shows another embodiment 540 of the patient support 520. As shown in FIG. 38, the patient support 540 includes a base 542, a plurality of adjustable bladders 544 extending upwardly from the base 542, and a plurality of foam inserts 546 located between the plurality of vertically-extending adjustable bladders 544. In the embodiment illustrated in FIG. 38, air escapes through the top surfaces 548 of the foam inserts 546 after it circulates through the foam inserts 546.

Figure 40:
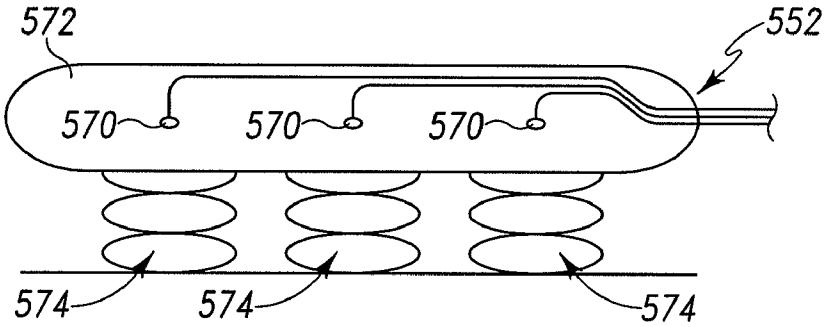
FIG. 40 is a side elevation view showing a plurality of sensors located on a web overlying a plurality of vertically-stacked adjustable bladders.
Figure 39:
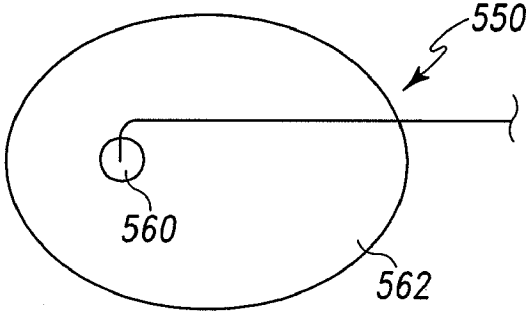
FIG. 39 is a top view showing a sensor located on an upwardly-facing surface of a localized patient support.
Figure 42:
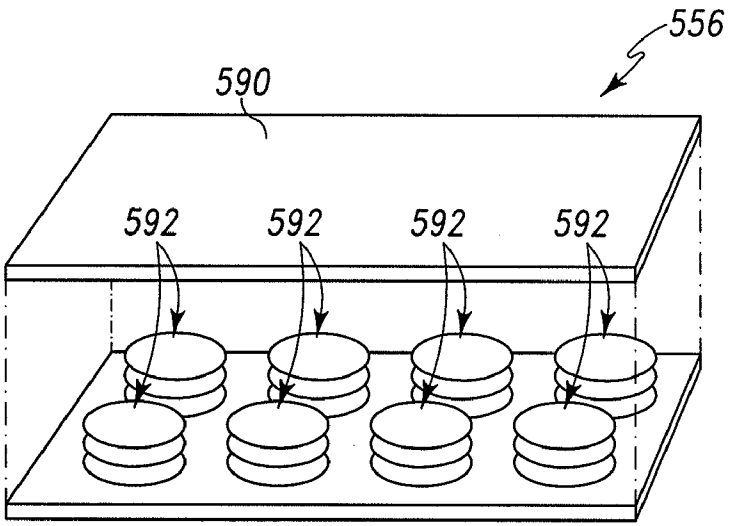
FIG. 42 is a side elevation view showing a sensor pad overlying a plurality vertically-stacked adjustable bladders.
Figure 41:
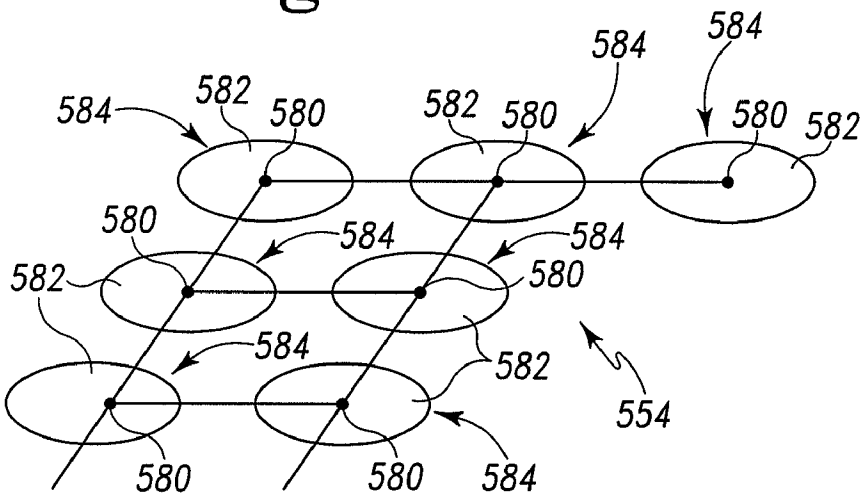
FIG. 41 is a top view showing a plurality of sensors located on the bladders.
Figure 43:
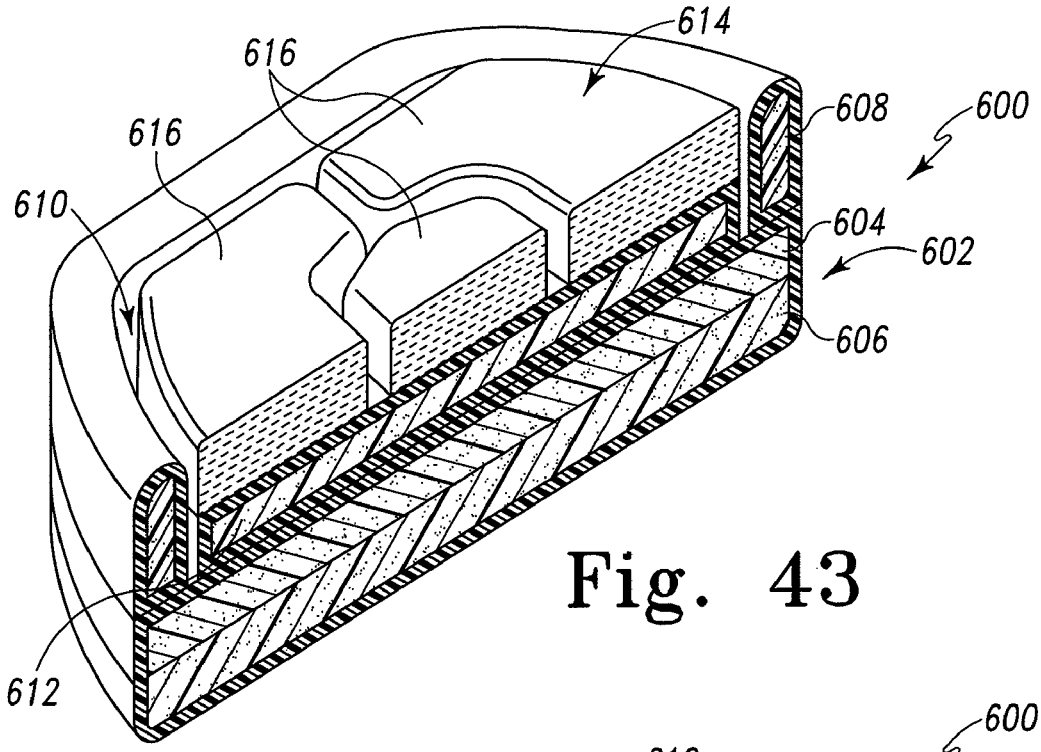
FIG. 43 is a sectional perspective view of another embodiment of a localized patient support showing the patient support having a foam base comprising upper and lower foam pads, an annular foam ring overlying the base and defining a cavity, a foam insert received in the cavity, and a sectioned or segments gel pad that has a plurality of relatively thick portions located in the cavity above the foam insert, and further showing the base, the annular foam ring, and the insert each encased in a respective outer skin.

FIGS. 39-42 show different arrangements 550, 552, 554, 556 of sensors 104 relative to patient supports 54. As indicated above, the apparatus 100 uses data from the sensors 104 to control the variables that affect integrity of a patient's skin. Some examples of the variables that affect integrity of a patient's skin include the pressure exerted by the patient supports 54 on a patient's skin, the temperature of the patient supports 54 adjacent a patient's skin, the moisture or humidity level at or near a patient's skin, the skin shear, the air circulation, and the like. FIG. 39 shows a single sensor 560 located on a bladder 562. FIG. 40 shows a plurality of sensors 570 located on a web 572 covering a plurality of vertically-stacked bladders 574. In the illustrated embodiment, the web 572 comprises a sheet of vinyl material. FIG. 41 shows a sensor 580 located on a top bladder 582 of each of the plurality of vertically stacked bladders 584. FIG. 42 shows a sensor grid 590 located on a plurality of vertically-stacked bladders 592. The sensor grid 590 may or may not be attached to top bladders of the plurality of vertically-stacked bladders 592. In the illustrated embodiments, the bladders 562, 574, 584, 592 are adjustable.

Figure 44:
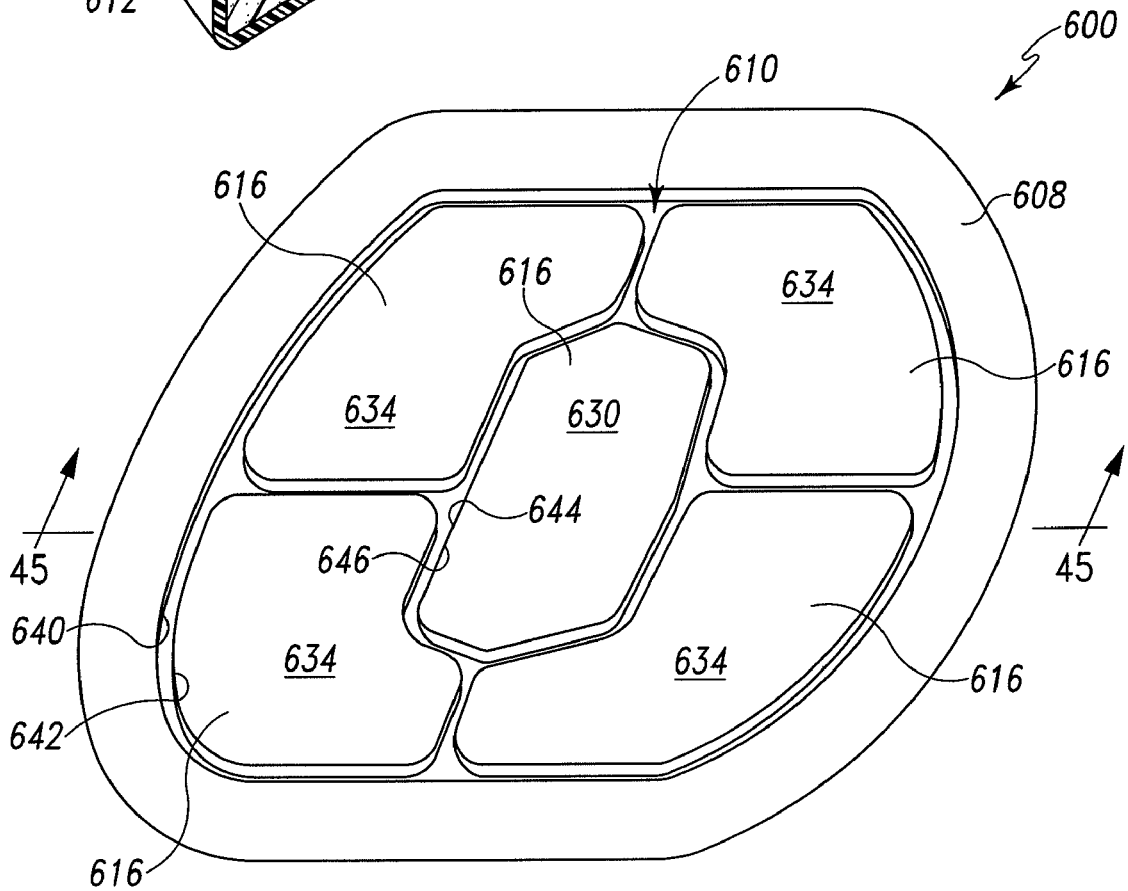
FIG. 44 is a top plan view of the patient support of FIG. 43.
Figure 45:
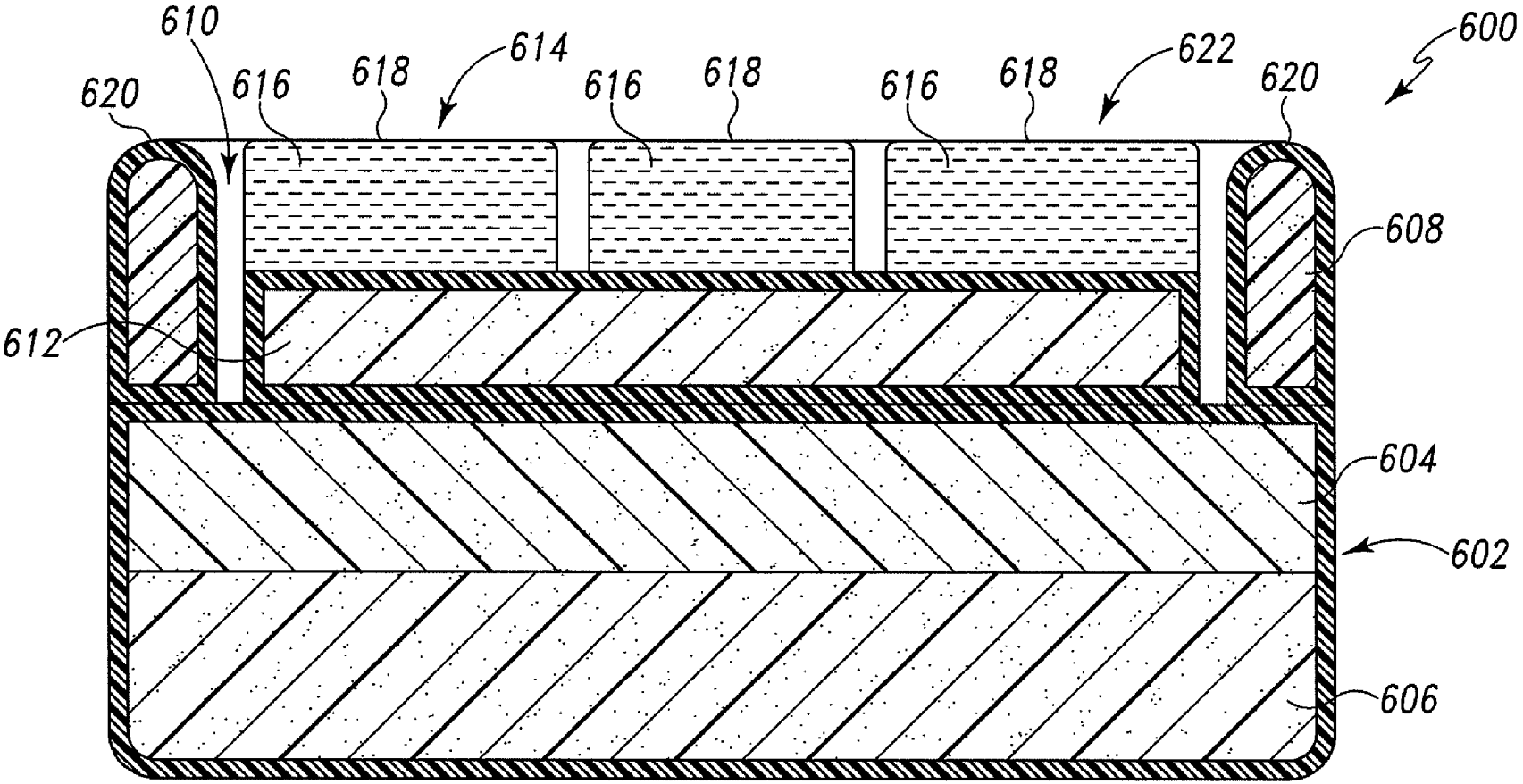
FIG. 45 is a cross sectional view of the patient support of FIGS. 43-44 along a line 45-45 in FIG. 44.

As shown in FIGS. 43-46, a localized patient support 600 includes a base 602 comprising upper and lower pads 604, 606, an annular ring 608 overlying the base 602 and defining a cavity 610, an insert 612 received in the cavity 610, and a sectioned or segmented gel pad 614 overlying the insert 612. In the drawings, sectional views of gel pads are indicated by horizontal dashed lines. As used in the description and claims, the term "annular" is used broadly to indicate an encircling arrangement. The annular ring 608, may be circular, square, rectangular, hexagonal, or any other suitable shape determined by a patient's anatomy. The gel pad 614 has a plurality of relatively thick sections or segments 616 located in the cavity 610 above the foam insert 612. As shown in FIG. 45, the sections 616 of the gel pad 614 are sized so that top surfaces 618 of the sections 616 of the gel pad 614 are substantially coplanar with a top surface 620 of the annular ring 608. The top surface 620 of the annular ring 608 and the top surfaces 618 of the sections 616 of the gel pad 614 define a substantially continuous surface 622 (FIG. 45) upon which a patient's anatomy may rest. The sections 616 of the gel pad 614 located in the cavity 610 are vertically movable substantially independently of adjacent sections 616 of the gel pad 614 in order to reduce hammocking effect.

As shown in FIG. 44, the sections 616 of the gel pad 614 comprise a central section 630 located in a central region of the cavity 610 and a plurality of peripheral sections 634 located in a peripheral region of the cavity 610. In the illustrated embodiment, the gel pad 614 has only one central section 630 and four peripheral sections 634. However, the gel pad 614 may very well have different number of sections in the central and peripheral regions of the cavity 610. As shown in FIG. 44, an inner peripheral wall 640 of the annular ring 608 is in a confronting relation with outer peripheral walls 642 of the peripheral sections 634 and an outer peripheral wall 644 of the central section 630 is in a confronting relation with inner peripheral walls 646 of the peripheral sections 634. The spacing between the confronting walls 640, 642 and 644, 646 is relatively small, about 0.125 inches (0.3175 centimeters) to limit lateral movement of the sections 616.

Figure 46:
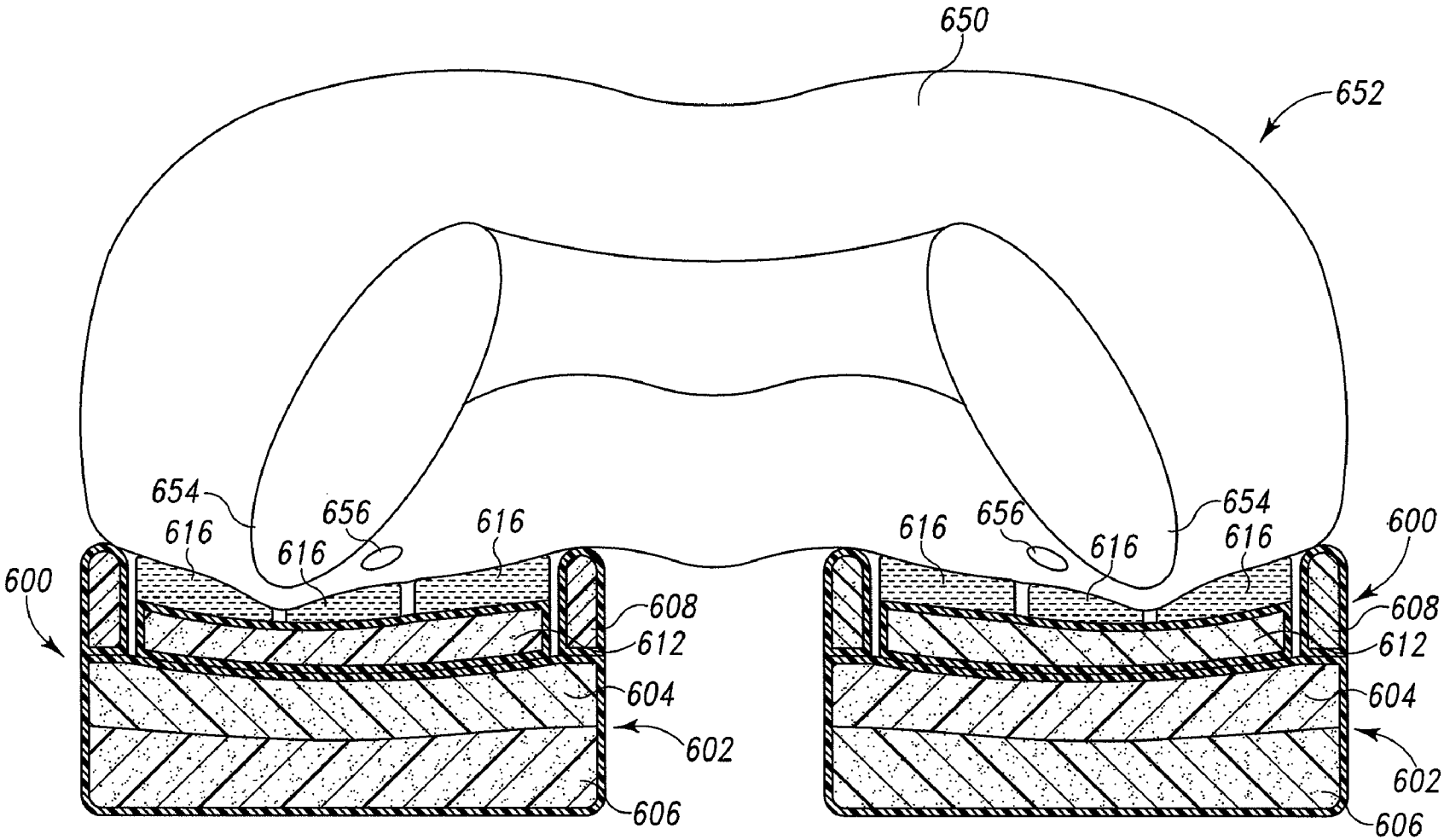
FIG. 46 is a cross sectional view showing a patient's pelvis region supported in a prone position on a pair of oppositely-disposed patient supports of FIGS. 43-45, and further showing a bony protrusion of the patient pushing down portions of the gel pad lying under the bony protrusion and a top surface of the gel pad following the contour of the patient's pelvis region.

FIG. 46 shows a pelvis region 650 of a patient 652 supported in a prone position on a pair of oppositely-disposed patient supports 600. As shown therein, bony protrusions 654 of the patient 652 push down sections 616 of the gel pad 614 that lie under the bony protrusions 654. The softness of the gel material, the sectional construction of the gel pad 614, and the spacing between peripheral walls 640, 642 and 644, 646 of the annular ring 608 and the gel pad sections 616 facilitate such downward movement of the gel pad sections 616 that lie under the bony protrusions 654 of the patient 652. Such downward movement of the sections 616 of the gel pad 614 reduces interface pressure to, in turn, reduce the risk of damage to patient's nerve or soft tissue 656 that lies between the bony protrusion 654 and the gel pad sections 616 during relatively long surgeries. The gel pads 614 are of the type marketed by TruLife, based in Dublin, Ireland.

In the illustrated embodiment, the base pad 602, the annular ring 608 and the insert 612 comprise foam elements having respective outer skins made from urethane coated knitted fabric. In some embodiments, the outer skin comprises "Sure-Chek Fusion" fabric marketed by Herculite Products Inc. Illustratively, the upper and lower foam pads 604, 606 are attached to each other and then covered with an outer skin to form the base pad 602 having a layered structure. The annular foam ring 608 is covered with an outer skin and then attached to the base pad 602. The insert 612 and the gel sections 616 are captured in the cavity 610 defined by the base pad 602 and the annular ring 608. In the illustrated embodiment, the upper and lower foam pads 604, 606 are connected to each other by an adhesive. However, other suitable means, such as heat sealing, sonic welding, sewing, tie straps, zippers, etc. may be used in other embodiments for connecting the upper and lower foam pads 604, 606. Likewise, in the illustrated embodiment, the base pad 602 and the annular ring 608 are sewn together. However, other suitable means, such as adhesives, heat sealing, sonic welding, tie straps, zippers, etc. may be used in other embodiments for connecting the base pad 602 and the annular ring 608.

In the illustrated embodiment, the upper and lower pads 604, 606, the annular ring 608 and the insert 612 all comprise foam elements having respective ILD values. It is known that pads made from softer foam having low ILD values, in general, produce lower interface pressures than pads made of harder foam having high ILD values. However, low ILD foam is easily compressible and therefore, a rather large thickness of low ILD foam is needed to prevent "bottoming" of a patient's body supported by the low ILD foam. Bottoming occurs when a foam element, or any type of support element, no longer supports the body, but rather, the body is being supported by whatever structure is beneath the foam element. Suitable foams for the upper and lower pads 604, 606, the annular ring 608 and the insert 612 are selected to reduce the risk of bottoming out without producing unnecessarily high interface pressures between the patient's skin and the patient support 600.

FIGS. 47-49 show another embodiment 700 of the patient support 600 of FIGS. 43-46. The patient support 700 is similar to the patient support 600, except that the foam insert 612 is replaced with a plurality of vertically-adjustable air bladders 702 and except that the gel pad 614 has a relatively thin annular section 704 overlying the annular foam ring 608. The vertically-adjustable air bladders 702 provide capacity to lower portions of the gel pad 614 lying under a patient's bony part to relieve interface pressure between the patient support 700 and the patient's skin during relatively long surgeries. Like reference numbers are used to designate similar parts in various embodiments. As shown in FIG. 48, in the illustrated embodiment, each section 616 of the gel pad 614 is positioned above two bladders 702. In some embodiments, however, each section 616 is positioned above one bladder 702. In still other embodiments, each section 616 is positioned above three or more bladders 702. In some embodiments, an upwardly-facing surface of each bladder 702 is attached to a downwardly-facing surface of the associated gel section 616 and a downwardly-facing surface of each bladder 702 is attached to an upwardly-facing surface of the base pad 602. Any suitable means, such as adhesives, heat sealing, sonic welding, sewing, tie straps, zippers, etc. may be used for connecting the bladders 702 to the gel pad 614 and the base pad 602.

Figure 59:
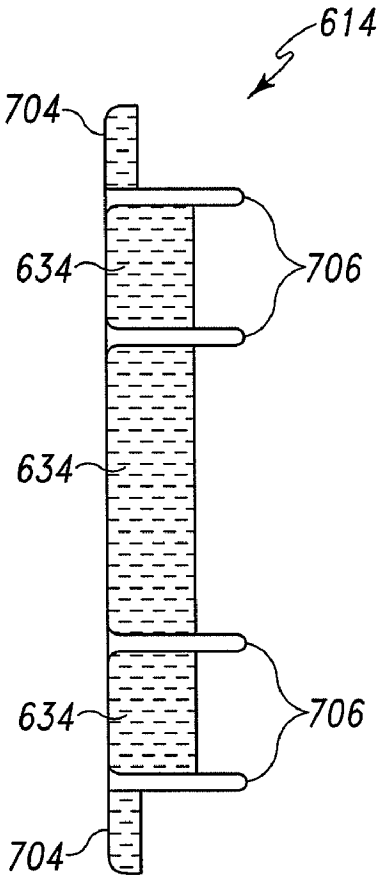
FIG. 59 is a cross sectional view along a line 59-59 in FIG. 58.
Figure 58:
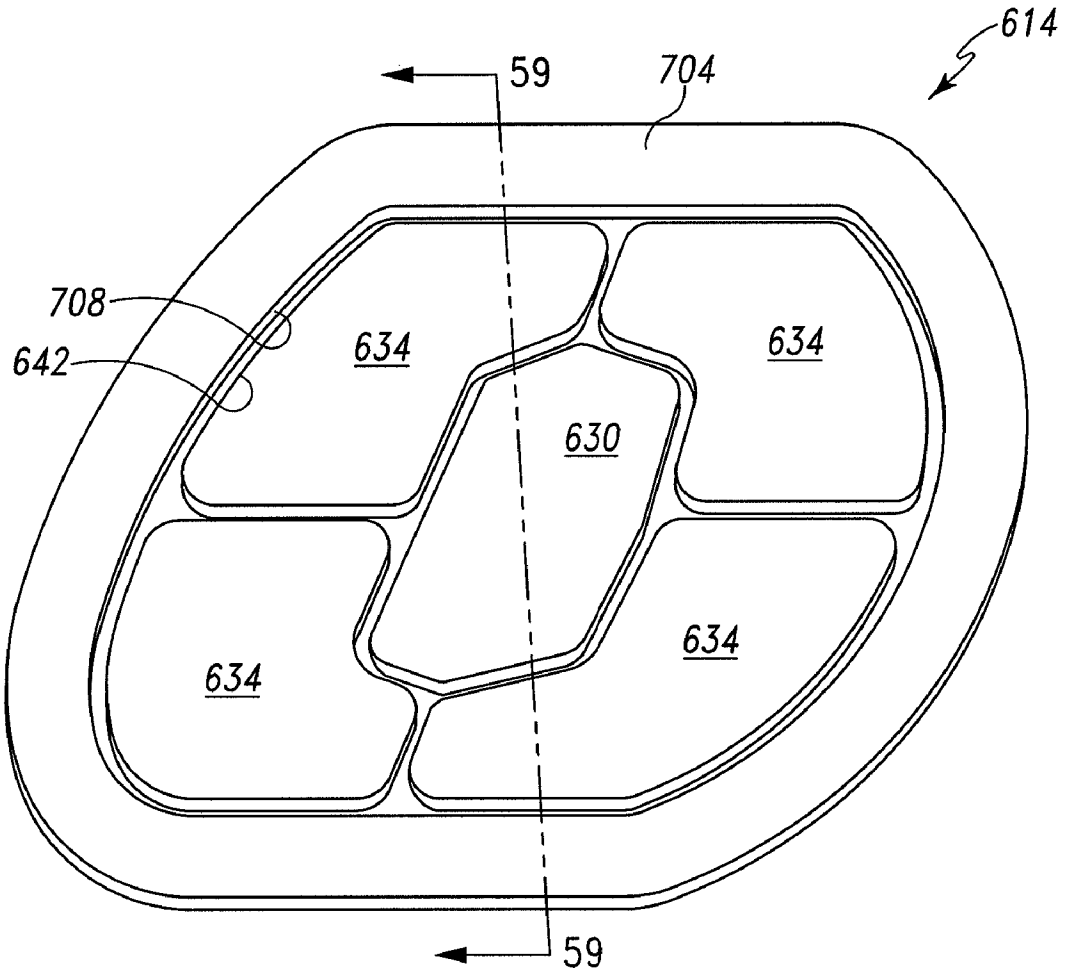
FIG. 58 is a top plan view showing the gel pad of FIGS. 47-55.

As shown in FIGS. 58-59, in the illustrated embodiment, the relatively thick central and peripheral sections 630, 634 of the gel pad 614 have a first thickness (about 0.75 inches or 1.9 centimeters) and the relatively thin annular section 704 of the gel pad 614 has a second thickness (about 0.25 inches or 0.63 centimeters) smaller than the first thickness. As shown in FIG. 58, the gel pad 614 has a plurality of downwardly-depending relatively thin web portions 706 (FIG. 59) interconnecting 1) an inner peripheral wall 708 of the annular section 704 with the outer peripheral walls 642 of the peripheral sections 634, 2) the inner peripheral walls 646 of the peripheral sections 634 with the outer peripheral wall 644 of the central section 630, and 3) the confronting inner peripheral walls 646 of the adjacent peripheral sections 634. In the embodiments illustrated in FIGS. 47-55, the gel pad 614 has a transverse dimension of about 9.31 inches (23.65 centimeters), a longitudinal dimension of about 6.94 inches (17.63 centimeters), a vertical dimension (including the web portions 706) of about 1.125 inches (3.175 centimeters). Also, in the embodiment illustrated in FIGS. 47-55, the relatively thin interconnecting web portions 706 comprise a flexible urethane sheet. Illustratively, the gel pad 614 is vacuum formed.

The vertically-adjustable air bladders 702 are independently inflatable and deflatable. Each bladder 702 is individually coupled to a pressure source 710, shown diagrammatically in FIG. 47, via a conduit 712. The pressure source 710 is, in turn, coupled to a controller 714 diagrammatically shown in FIG. 47. The controller 714 varies the air pressure in the individual bladders 702 to vary their firmness, as well as their height. This allows a caregiver to deflate, partially or wholly, one or more bladders 702 under a patient's bony protrusion 654, to, in turn, allow portions of the gel pad 614 to sink into a space vacated by the deflated air bladders 702 as shown, for example in FIG. 55. This reduces interface pressure to, in turn, reduce the risk of tissue or nerve damage. In some embodiments, the bladders 702 are periodically sequentially deflated and reinflated in a predetermined pattern to reduce the risk of interruption of blood flow to soft tissue.

FIGS. 50-53 show another embodiment 800 of the patient support 700 of FIGS. 47-49. The patient support 800 is similar to the patient support 700, except that the patient support 800 includes a plurality of sensors 802 coupled to the gel pad 614. Like reference numbers are used to designate similar parts in various embodiments. In the illustrated embodiment, the sensors 802 are pressure sensors. In the illustrated embodiment, two sensors 802 are located above each section 616 of the gel pad 614 received in the cavity 610. As previously indicated, each section 616 is, in turn, located above two air bladders 702. In some embodiments, however, one sensor 802 is located above each section 616 of the gel pad 614. In still other embodiments, three or more sensors 802 are located above each section 616 of the gel pad 614. In addition, sensors 802 are located above the annular section 704 of the gel pad 614.

Figure 50:
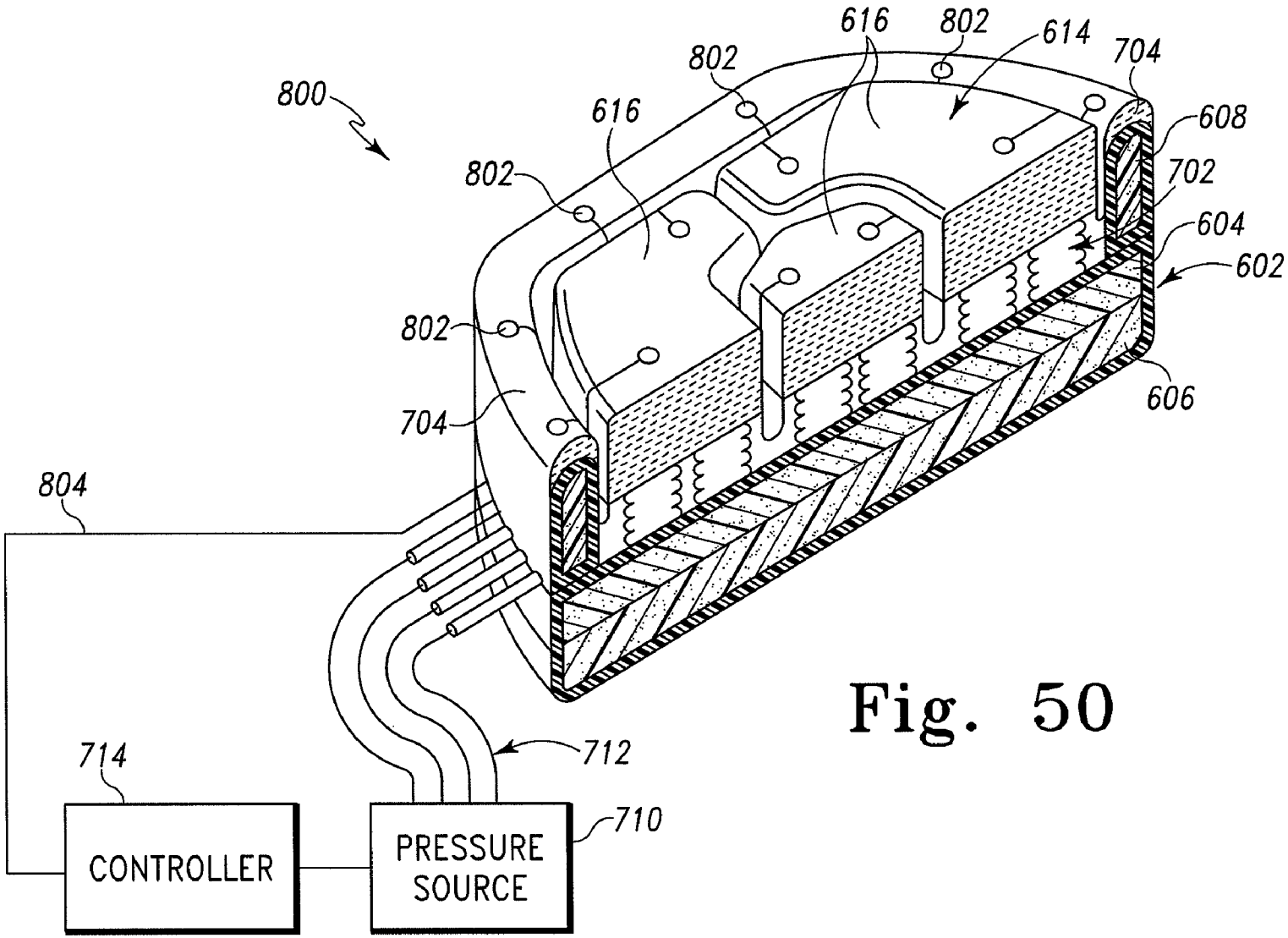
FIG. 50 is a sectional perspective view of yet another embodiment of a localized patient support similar to the patient support shown in FIGS. 47-49, except that the patient support of FIG. 50 includes a plurality of pressure sensors overlying the gel pad, and further showing a pressure source coupled to the bladders and a controller coupled to the sensors and coupled to the pressure source.
Figure 51:
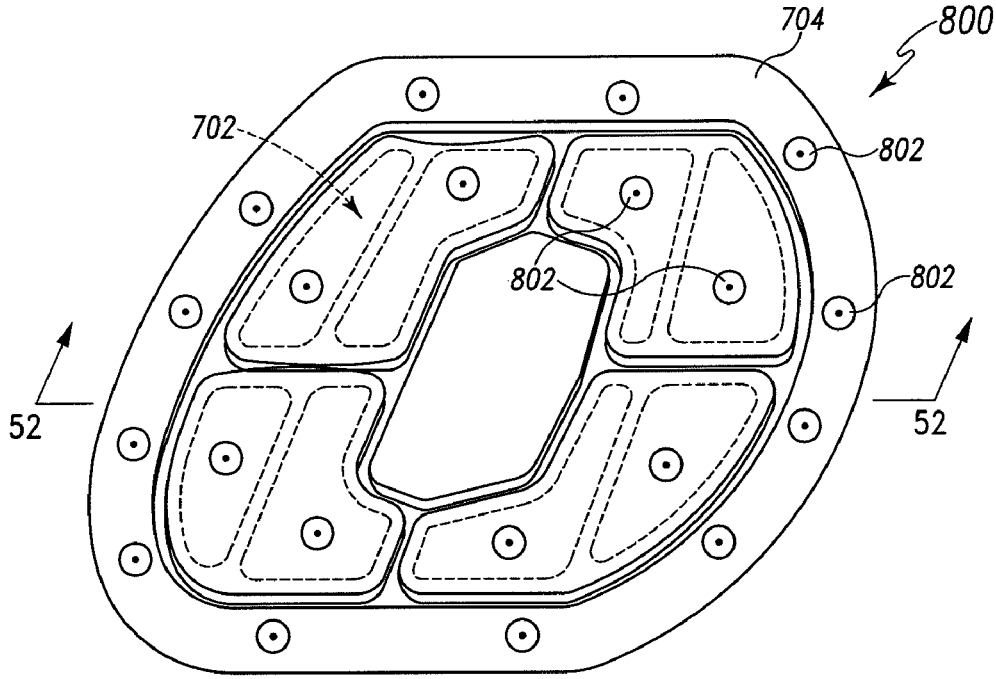
FIG. 51 is a top plan view of the patient support of FIG. 50 showing the plurality of sensors overlying the gel pad.
Figure 55:
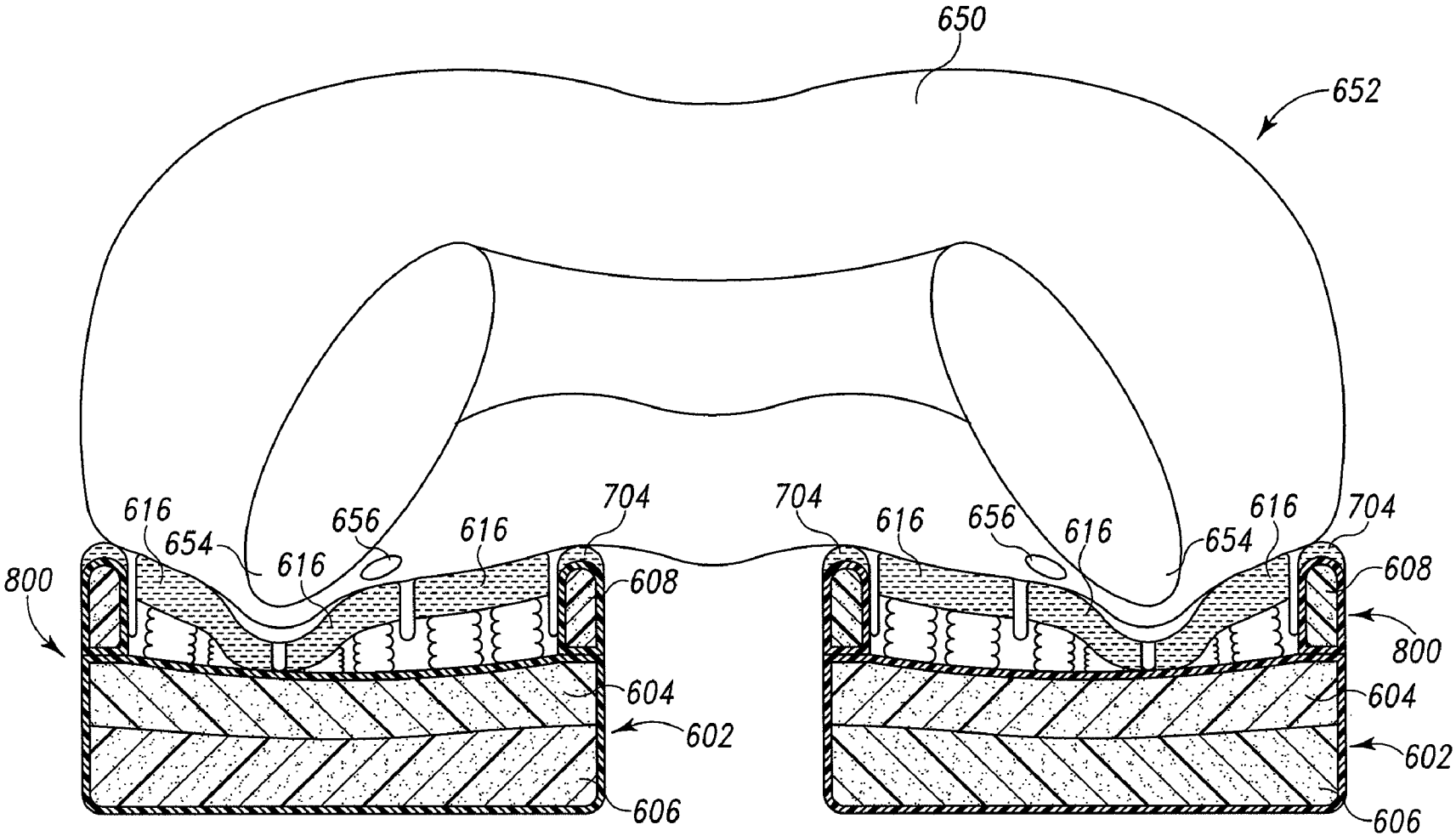
FIG. 55 is a cross sectional view, similar to FIG. 54, showing one of the air bladders under the patient's bony protrusion deflated to allow a portion of the gel pad lying under the bony protrusion sink into a space vacated by the deflated air bladder.
Figure 56:
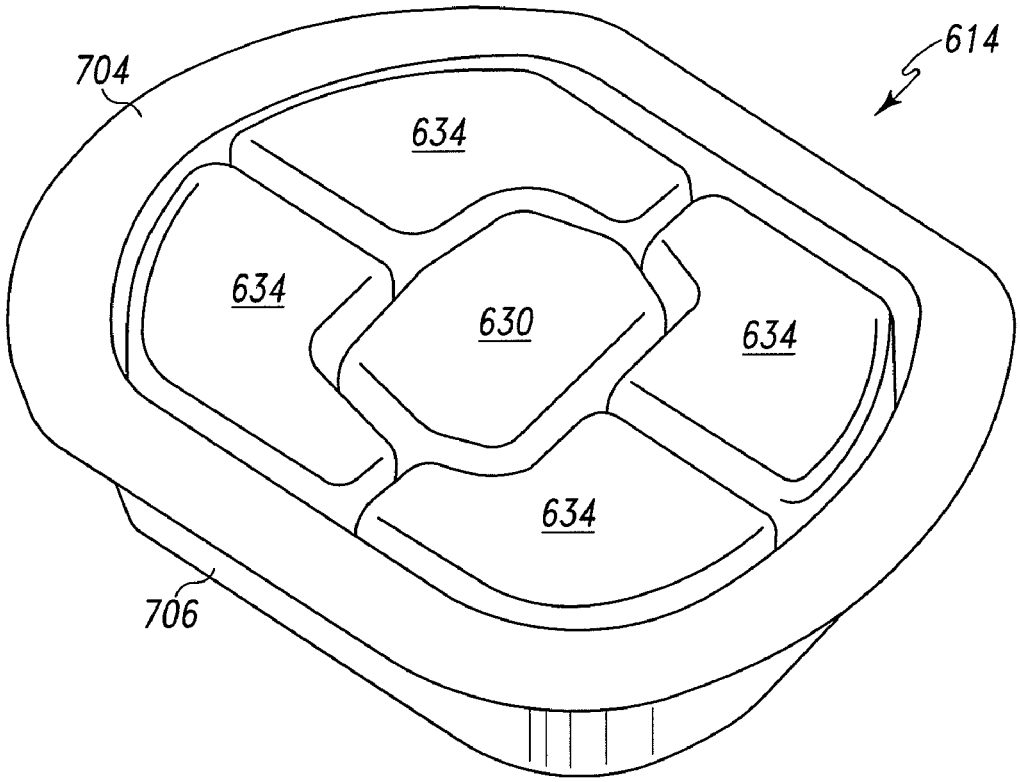
FIG. 56 is a top perspective view of the gel pad of FIGS. 47-55.
Figure 57:
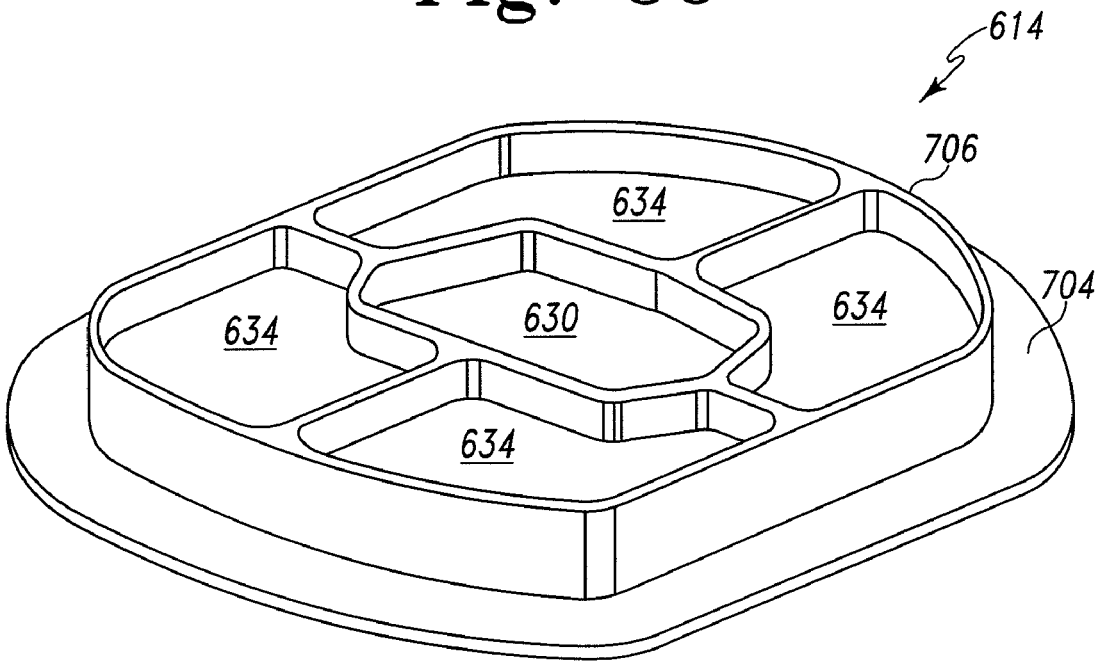
FIG. 57 is a bottom perspective view of the gel pad of FIGS. 47-55.
Figure 60:
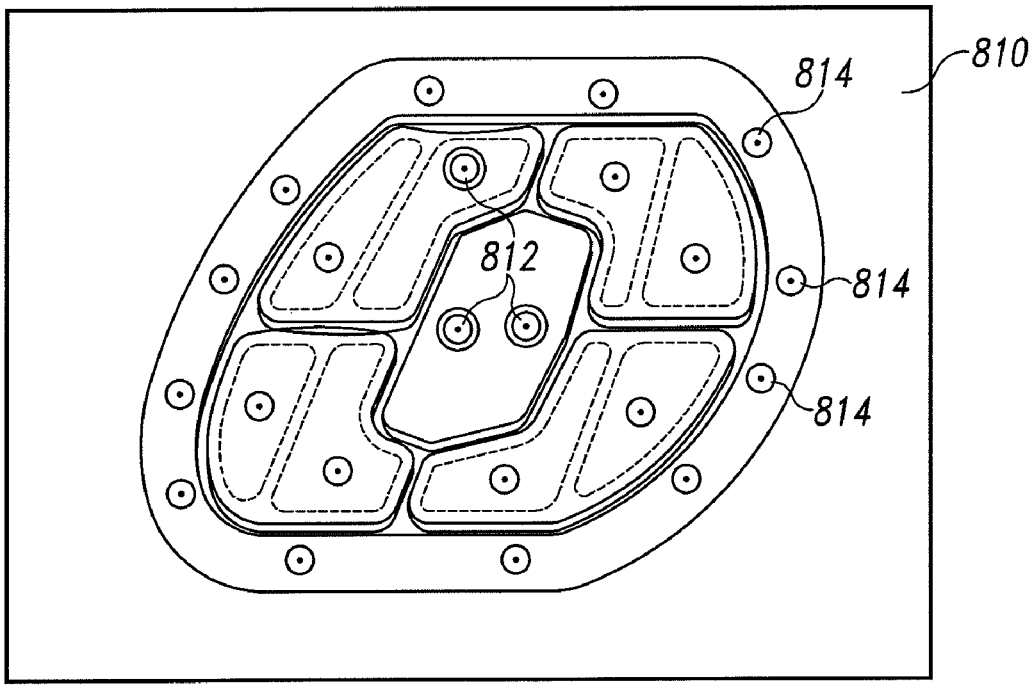
FIG. 60 is a screen shot showing that pressure readings outputted by three sensors lying under a patient's bony protrusion being higher than pressure readings outputted by the remaining sensors.
Figure 61:
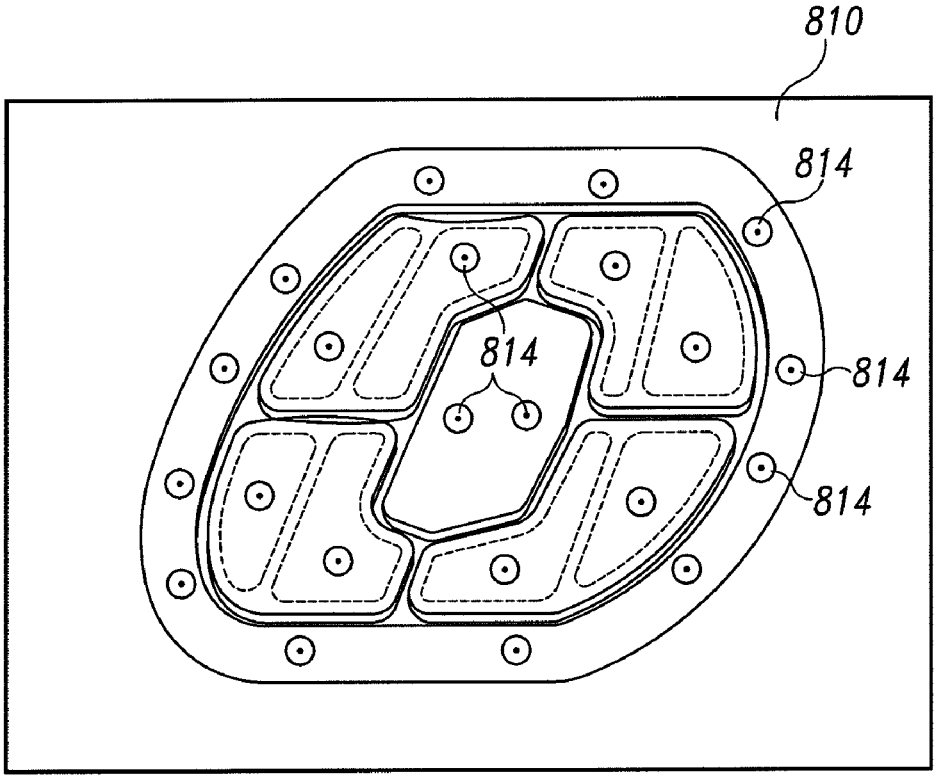
FIG. 61 is a screen shot showing uniform pressure readings after deflating the three air bladders lying below the three sensors outputting higher pressures.

Each pressure sensors 802 is individually coupled to the controller 714, shown diagrammatically in FIG. 50, via a respective conductor 804. As shown in FIGS. 60-61, the output of the pressure sensors 802 is displayed on a display 810 (FIGS. 60-61) coupled to the controller 714. In FIGS. 60-61, in the illustrated embodiment, the outputs of the pressure sensors 802 are superimposed on an image of the associated patient support 800. In an illustrative example shown in FIG. 60, three sensors 812 lying under a patient's bony protrusion 654 are subjected to higher pressures than the remaining sensors 814. Armed with this information, a caregiver can deflate one or more bladders 702 that lie below the bony protrusion 654 to produce relatively uniform interface pressure across the patient support 800 as indicated in FIG. 61 to reduce the risk of tissue or nerve damage. As shown in FIG. 55, portions of two gel pad section 616 sink into the space vacated by the deflated air bladders 702. In some embodiments, however, the controller 714, in response to inputs from the pressure sensors 802, automatically deflates the associated bladders 702 to produce relatively uniform pressure over the entire surface as shown, for example, in FIG. 65. In still other embodiments, the controller 714, in response to inputs from the pressure sensors 802, automatically deflates the associated bladders 702 to a degree that causes the associated gel sections 616 to be spaced from the patient's bony protrusions 654 as shown, for example, in FIG. 66.

Figure 52:
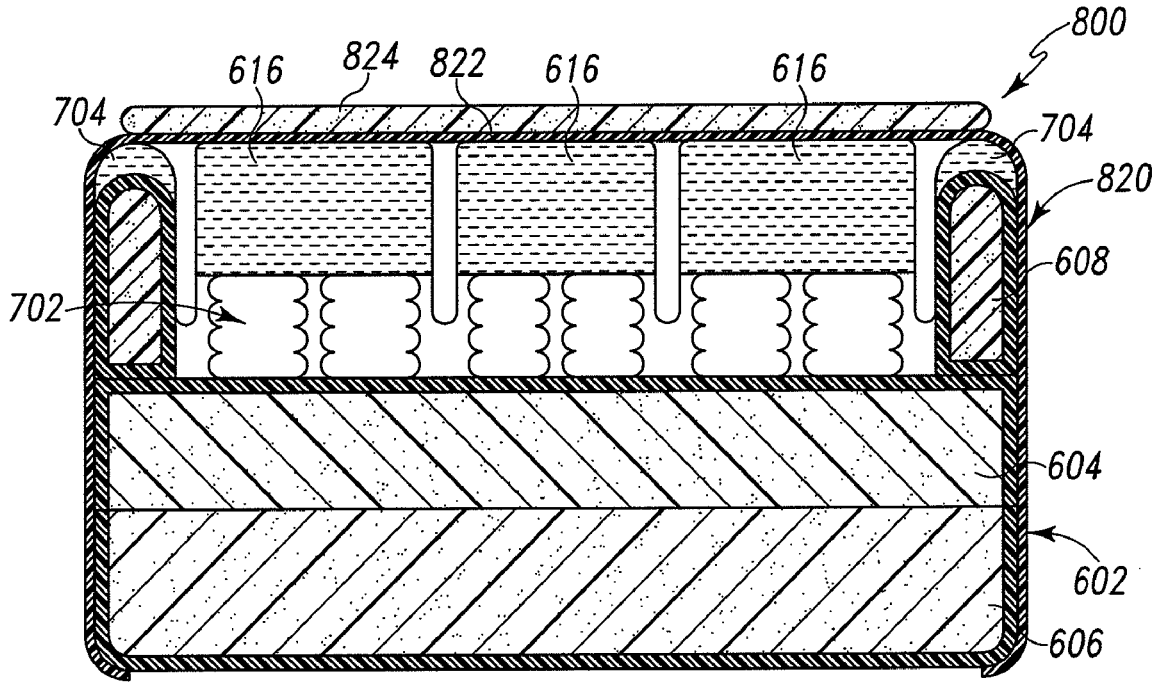
FIG. 52 is a cross sectional view of the localized patient support of FIGS. 50-51 along a line 52-52 in FIG. 51 showing the patient support encased in a stretchable anti-shear disposable cover and a foam pad overlying the disposable cover.
Figure 53:
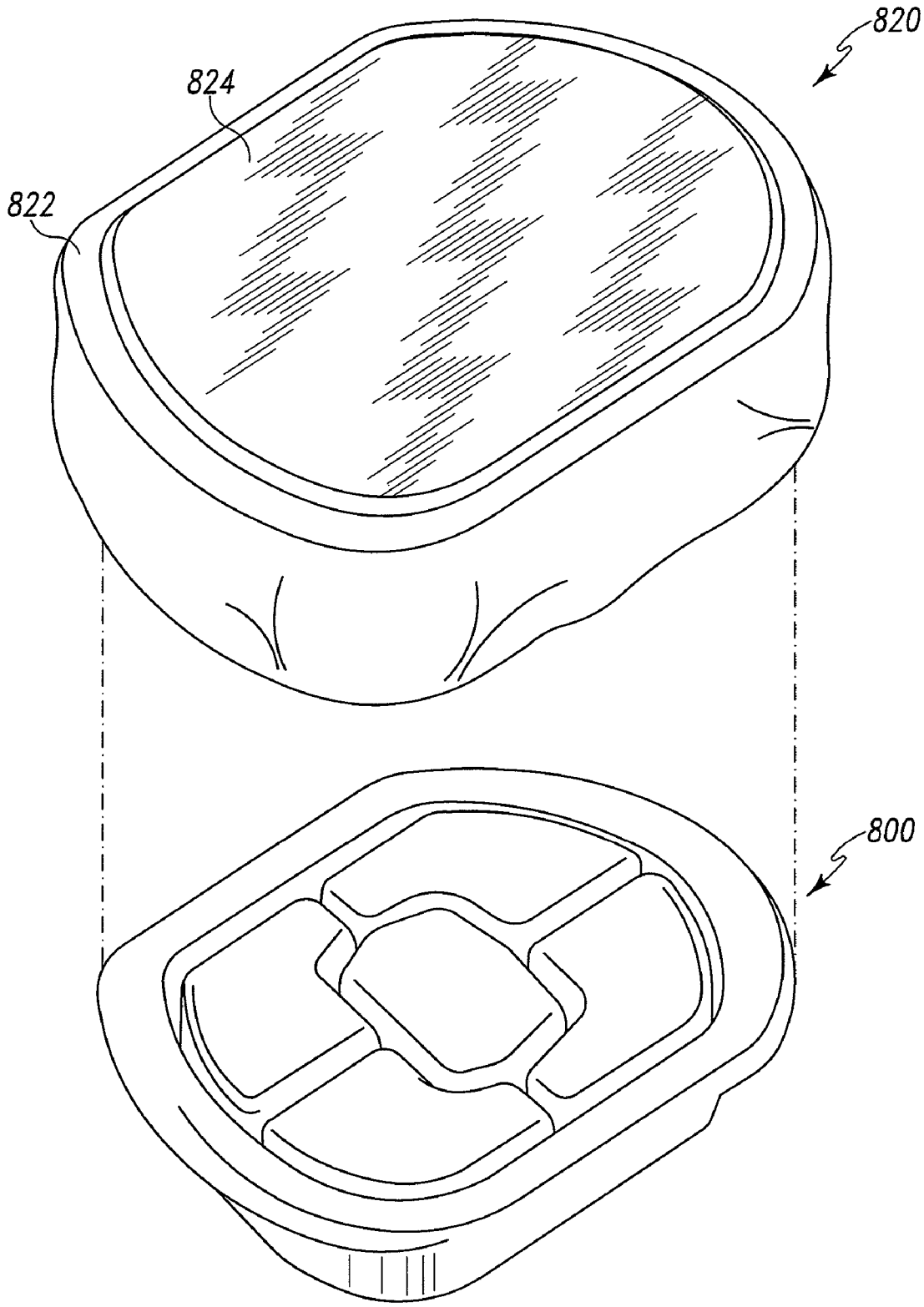
FIG. 53 is a perspective view showing the stretchable disposable cover of FIG. 52 positioned above the localized patient support of FIGS. 50-51.
Figure 54:
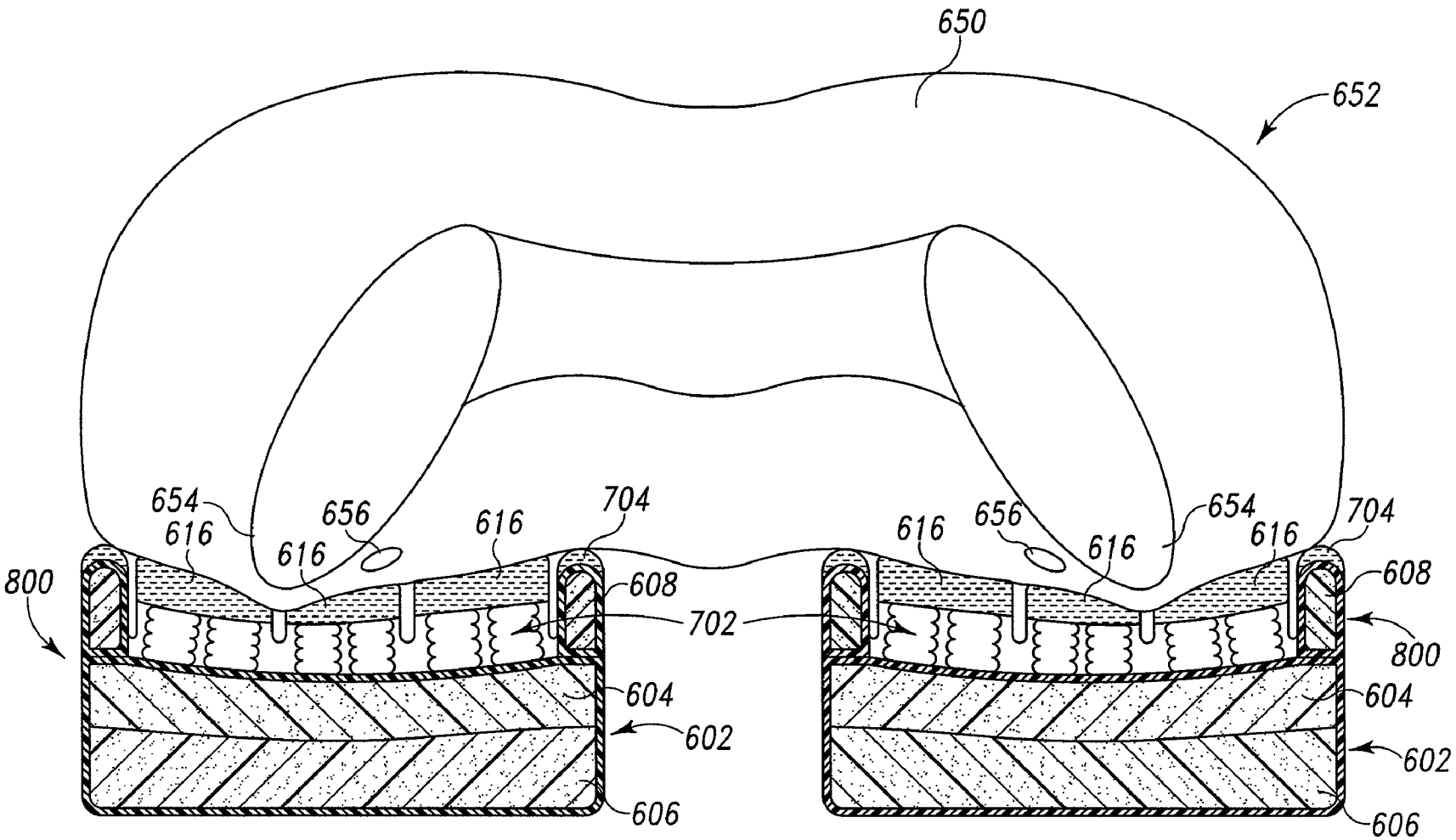
FIG. 54 is a cross sectional view, similar to FIG. 47, showing a patient's pelvis region supported in a prone position on a pair of oppositely-disposed patient supports of FIGS. 50-54, and further showing a bony protrusion of the patient pushing down portions of the gel pad lying under the bony protrusion and a top surface of the gel pad following the contour of the patient's pelvis region.

As shown in FIGS. 52-53, in the illustrated embodiment, the patient support 800 is encased in a disposable protective cover 820. The cover 820 has a stretchable anti-shear or low-friction portion 822 that covers a top surface of the patient support 800. The stretchable anti-shear portion 822 of the cover 820 does not provide support to patient's bony protrusions, thereby reducing the hammocking effect. In other words, the stretchable anti-shear portion 822 allows patient's bony protrusions to sink between the gel sections 616 or push down on the gel sections 616 without producing back pressure on the patient. A foam pad 824 is coupled to a top side of the stretchable anti-shear portion 822. However, in some embodiments, the entire cover 820 is made from a stretchable anti-shear fabric that does not provide back pressure. The disposable cover 820 reduces the risk of cross contamination of patients' bodily fluids. In the illustrative embodiment, the stretchable anti-shear fabric 822 comprises 96% nylon and 4% spandex.

FIG. 62 is a cross sectional view of still another embodiment 900 of a localized patient support similar to the patient support 600 shown in FIGS. 43-46, except that the foam insert 612 and the sectioned gel pad 614 are replaced with a single air bladder 902. FIG. 63 is a cross sectional view of yet another embodiment 910 of a localized patient support similar to the patient support 900 shown in FIG. 62, except that the single air bladder 902 is replaced with multiple air bladders 912.

FIGS. 64-66 diagrammatically show a pressure control system 920 comprising a base 922, a plurality of vertically-adjustable air bladders 924 extending upwardly from the base 922, a sectioned gel pad 926 supported above the bladders 924, a plurality of pressure sensors 928 coupled to the gel pad 926, a pressure regulator 930 coupled to the air bladders 924, and a processor 932 coupled to the pressure sensors 928 and coupled to the air bladders 924. In the illustrated embodiment, the gel pad 926 comprises a plurality of sections 940, each of which is vertically movable substantially independently of adjacent sections 940 of the gel pad 926 to reduce hammocking effect. Illustratively, the bladders 924 and the gel pad sections 940 are sized so that the top surfaces of the gel pad sections 940 are substantially coplanar. In the illustrated embodiment, each section 940 of the gel pad 926 is positioned above two bladders 924. In some embodiments, however, each section 926 is positioned above one bladder 924. In still other embodiments, each section 926 is positioned above three or more bladders 924. In the illustrated embodiment, two sensors 928 are located above each section 940 of the gel pad 926. In some embodiments, however, one sensor 928 is located above each section 616 of the gel pad 614. In still other embodiments, three or more sensors 802 are located above each section 940 of the gel pad 926.

In the illustrated embodiment, there are ten bladders 924 and ten pressure sensors 928, numbered 1 to 10 from left to right. Each bladder 924 is individually coupled to the pressure regulator 930. Likewise, each pressure sensor 928 is individually coupled to the processor 932. The outputs of the ten pressure sensors 928 are indicated by a bar chart 934, where the height of the shaded portions indicates pressure. As shown in FIGS. 64-66, the base 922, the vertically-adjustable bladders 924, and the gel pad 926 define a localized patient support 950 that supports a patient's anatomy 952 having downwardly-extending protrusions 954, 956. The protrusion 954 on a left side is the result of a bone 955 located close to the patient's skin. The protrusion 956 on a right side is the result of a blood vessel 957 located close to the patient's skin. As shown by the bar chart 934 in FIG. 64, the bony protrusion 954 causes the third and fourth pressure sensors 928 to output higher pressure readings, while the protrusion 956 caused by the blood vessel 957 causes the seventh pressure sensor 928 to output a higher pressure reading.

In the embodiment shown in FIG. 65, in response to the inputs from the pressure sensors 928, the processor 932 is programmed to reduce the heights of the third, fourth and seventh bladders 924 such that the pressure readings outputted by the ten pressure sensors 928 are relatively uniform as shown by the bar chart 934 in FIG. 65. However, in the embodiment shown in FIG. 66, in response to the inputs from the pressure sensors 928, the processor 932 is programmed to reduce the heights of the third, fourth, and seventh bladders 924 to a degree that causes portions of the associated gel pad sections 940, and the pressure sensors located thereon, to be spaced from the two protrusions 954, 956. As a result, the pressure readings outputted by the third, fourth, and seventh sensors 928 drop to zero as shown by the bar chart 934 in FIG. 66. In addition to reducing the heights of the third, fourth, and seventh bladders 924, in some embodiments, the processor 932 is programmed to provide alternating pressure relief in the remaining bladders 924 (i.e., first, second, fifth, sixth, eighth, ninth and tenth bladders 924).

Although certain illustrative embodiments have been described in detail above, variations and modifications exist within the scope and spirit of this disclosure as described and as defined in the following claims.

The invention claimed is:

1. A localized patient support for supporting only a portion of a patient's body above a surgical table when the patient is lying in a prone position, the localized patient support comprising:

a base made of foam, an annular ring being a separate piece supported above an outermost peripheral region of the base and defining a cavity, the annular ring being curved along at least one of a side and an end thereof, an insert above the base and situated in the cavity, and a gel pad having a plurality of sections located in the cavity and overlying the insert, sections of the gel pad located in the cavity being vertically adjustable substantially independently of adjacent sections of the gel pad to relieve pressure between the patient and support by varying the height of a section, and wherein the base, the annular ring, and the gel pad are together sized and configured to support only a portion of one of the patient's chest region and the patient's pelvic regions above the surgical table.

2. The localized patient support of claim 1, wherein the base comprises a first foam pad and a second foam pad.

3. The localized patient support of claim 1, wherein the annular ring comprises a foam ring.

4. The localized patient support of claim 1, further comprising an outer skin surrounding the insert that is received in the cavity and located between the base and the gel pad.

5. The localized patient support of claim 4, wherein the insert comprises a foam insert.

6. The localized patient support of claim 1, wherein the sections of the gel pad received in the cavity are sized so that a top surface of the annular ring and top surfaces of the sections of the gel pad received in the cavity define a substantially continuous surface upon which the portion of the patient rests.

7. The localized patient support of claim 1, wherein the gel pad further comprises a plurality of web portions interconnecting adjacent sections of the gel pad.

8. The localized patient support of claim 1, wherein the plurality of sections of the gel pad comprise a central section and a plurality of peripheral sections around the central section.

9. The localized patient support of claim 8, wherein the peripheral sections are spaced from the central section.

10. The localized patient support of claim 9, wherein the peripheral sections are spaced from each other.

11. The localized patient support of claim 10, wherein the spacing between the central section and the peripheral sections is by a distance that is substantially equivalent to the spacing of the peripheral sections from each other.

12. The localized patient support of claim 10, wherein the spacing between the central section and the peripheral sections is about 0.125 inches and the spacing between adjacent peripheral sections is about 0.125 inches.

13. The localized patient support of claim 1, further comprising a first outer skin covering the base and a second outer skin covering the annular ring.

14. The localized patient support of claim 13, wherein the first and second outer skins comprise urethane coated knitted fabric.

15. A localized patient support for supporting only a portion of a patient's body above a surgical table when the patient is lying in a prone position, the localized patient support comprising:

a base made of foam, an annular ring being a separate piece supported above an outermost peripheral region of the base and defining a cavity, the annular ring being curved along at least one of a side and an end thereof, an insert above the base and situated in the cavity, a gel pad having a plurality of sections located in the cavity and overlying the insert, means for vertically moving at least one of the sections of the gel pad located in the cavity substantially independently of adjacent sections of the gel pad to relieve pressure between the patient and support, and wherein the base, the annular ring, and the gel pad are together sized and configured to support only a portion of one of the patient's chest region and the patient's pelvic regions above the surgical table.

16. A localized patient support for supporting only a portion of a patient's body above a surgical table when the patient is lying in a prone position, the localized patient support comprising:

a base made of foam, an annular ring being a separate piece supported above an outermost peripheral region of the base and defining a cavity, the annular ring being curved along at least one of a side and an end thereof, a gel pad having a plurality of sections located in the cavity and overlying the insert, sections of the gel pad located in the cavity being vertically movable substantially independently of adjacent sections of the gel pad to relieve pressure between the patient and support by varying the height of a section, and wherein the base, the annular ring, and the gel pad are together sized and configured to support only a portion of one of the patient's chest region and the patient's pelvic regions above the surgical table.

17. The localized patient support of claim 4, wherein the insert comprises a plurality of bladders which are independently inflatable and deflatable.

18. The localized patient support of claim 17, wherein each section of the gel pad received in the cavity is positioned above at least one bladder.

19. The localized patient support of claim 18, further comprising at least one sensor located above each section of the gel pad received in the cavity.

20. The localized patient support of claim 17, wherein each section of the gel pad received in the cavity is positioned above at least two bladders.

21. The localized patient support of claim 20, further comprising at least two sensors located above each section of the gel pad received in the cavity.

22. The localized patient support of claim 21, wherein the sensors measure one or more of the following parameters: pressure, temperature, humidity level, and air circulation.

23. The localized patient support of claim 4, wherein the base comprises a foam pad, the annular ring comprises a foam ring, the insert comprises a plurality of bladders which are independently inflatable and deflatable, and each section of the gel pad received in the cavity is positioned above at least two bladders.

24. The localized patient support of claim 23, wherein and the gel pad further comprises an annular section overlying the annular ring.

25. The localized patient support of claim 24, further comprising at least one sensor located above each section of the gel pad received in the cavity and a plurality of sensors located above the annular section of the gel pad overlying the annular ring.

26. The localized patient support of claim 1, further comprising a disposable cover having a stretchable anti-shear portion configured to substantially cover a top surface of the annular ring and top surfaces of the sections of the gel pad received in the cavity.

27. The localized patient support of claim 26, further comprising a foam pad supported above the stretchable anti-shear portion of the cover.

* * * * *